US005485182A

United States Patent [19]

Takayanagi et al.

[11] Patent Number: 5,485,182

[45] Date of Patent: Jan. 16, 1996

[54] LIQUID JET RECORDING APPARATUS

[75] Inventors: Yoshiaki Takayanagi; Asao Saito; Ryoichi Koizumi; Akira Nagatomo, all of Yokohama, Japan

[73] Assignee: Canon Kabushiki Kaisha, Tokyo, Japan

[21] Appl. No.: 290,071

[22] Filed: Aug. 15, 1994

Related U.S. Application Data

[63] Continuation of Ser. No. 841,285, Feb. 28, 1992, abandoned, which is a continuation of Ser. No. 457,192, Dec. 26, 1989, abandoned.

[30] Foreign Application Priority Data

| | | | |
|---|---|---|---|
| Dec. 29, 1988 | [JP] | Japan | 63-331185 |
| Jan. 12, 1989 | [JP] | Japan | 1-3862 |
| Mar. 29, 1989 | [JP] | Japan | 1-74913 |

[51] Int. Cl.[6] ..... B41J 29/38

[52] U.S. Cl. ..... 347/17; 347/19; 347/49

[58] Field of Search ..... 347/17, 19, 49, 347/50, 67

[56] References Cited

U.S. PATENT DOCUMENTS

| | | | |
|---|---|---|---|
| 4,250,512 | 2/1981 | Kattner et al. | 347/17 |
| 4,275,402 | 6/1981 | Kern | 347/14 |
| 4,396,923 | 8/1983 | Noda | 347/49 |
| 4,459,469 | 7/1984 | Ishima | 219/497 |
| 4,741,634 | 5/1988 | Nozaki et al. | 400/125 |
| 4,803,500 | 2/1989 | Milbrandt et al. | 347/49 |
| 4,910,528 | 3/1990 | Firl et al. | 347/17 |
| 5,049,898 | 9/1991 | Arthur et al. | 347/19 |
| 5,182,578 | 1/1993 | Goepel et al. | 347/60 |
| 5,235,351 | 8/1993 | Koizumi | 347/14 |

FOREIGN PATENT DOCUMENTS

| | | | |
|---|---|---|---|
| 0315417 | 5/1989 | European Pat. Off. . | |
| 3233425 | 4/1984 | Germany . | |
| 61-211045 | 9/1986 | Japan | 347/17 |
| 63-257648 | 10/1988 | Japan . | |
| 8903768 | 5/1989 | WIPO . | |

OTHER PUBLICATIONS

Lonis, "Storage of Operating Parameters in Memory Integral with with Printhead", *Xerox Disclosure Journal*, vol. 8, No. 6, Nov./Dec. 1983.

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

In order to prevent change in the properties of recording liquid such as surface tension, viscosity, etc. a recording head is provided with an integral temperature sensor. The temperature controlling operation is performed in response to an output of the temperature sensor to maintain the recording liquid within a predetermined temperature range. In order to correct the variation in the properties of the individual temperature sensors, the main apparatus contains a reference temperature sensor. The temperature sensor of the recording head is corrected in its output on the basis of comparison between the temperature sensors. The recording head is provided with information representative of a property of the temperature sensor of the recording head. By the mounting of the recording head into the apparatus, the information is read, and the output of the temperature sensor is corrected on the basis of the read information.

31 Claims, 31 Drawing Sheets

| FIG. 28A | FIG. 28B |
|---|---|

LIQUID JET RECORDING APPARATUS

This application is a continuation of application Ser. No. 07/841,285 filed Feb. 28, 1992, now abandoned and which is a continuation of application Ser. No. 07/457,192 filed Dec. 26, 1989, now abandoned.

FIELD OF THE INVENTION AND RELATED ART

The present invention relates to a liquid jet recording apparatus wherein an image is recorded on a recording material by ejecting recording liquid.

The liquid jet recording head used with such an apparatus is noteworthy because the recording density can be easily increased, because mass-production is easy and because the manufacturing cost is not high. These advantages result from the features that liquid jet recording outlets such as an orifice or the like for ejecting the recording liquid (ink) droplets can be arranged at a high density so that a high resolution printing is possible, that the entire size of the recording head can be easily reduced, that the semiconductor manufacturing technology (IC) and/or a micro-processing technique (which have been remarkably improved recently in terms of their reliability) can be used to good advantages, and that it is easy to manufacture an elongated head or a two-dimensional head.

Along with the demand for the low-cost, a disposable recording head or a recording head cartridge having a recording head and an ink container for supplying ink to the recording head, as a unit, have been proposed to facilitate the mounting and dismounting operation relative to the main assembly of the apparatus. This is advantageous in that the failure or the like of the recording head can be easily recovered, and in that the ink can be easily replenished in the cartridge type recording head. It follows that the maintenance and servicing operations for the apparatus can be omitted or simplified.

When the disposable recording head or the head cartridge is mounted into the main assembly, it is known that the electric contacts in the form of connectors provided in the head or head cartridge and the main assembly are connected to establish the electric connection therebetween. By the electric connection established, the driving signals can be transmitted from the control system of the main assembly to the electrothermal transducer (ejection energy generating element) of the recording head, and in addition, various parameters of the recording head or the head cartridge can be transmitted to the main assembly.

In the recording head of the liquid jet recording type, ejection failure can occur due to various causes such as ink solidification or introduction of external air (bubble) into the nozzle attributable to vibration or the high temperature drive of the head. Particularly when the ejection energy generating element includes a heat generating element (ejection heater) which uses thermal energy for the ink ejection, the head is easily heated to a high temperature. During normal ejection operation, most of the heat is carried over by the ejected ink, and therefore, the temperature of the head increases only up to approximately 50°–60° C. However, if the drive is continued when ejection failure occurs, the heat generated by the heater is all accumulated in the head, with the possible result that the temperature of the head reaches up to 150° C. or higher. If this occurs, the recording head is liable to be broken.

In consideration of the above, the liquid jet recording apparatus of this type includes a temperature detecting element (temperature sensor) to detect abnormal temperature increases to avoid the above inconveniences.

In addition, the temperature of the recording liquid is a very important parameter in the liquid jet recording apparatus. This is because the various properties such as surface tension or viscosity of the recording liquid change depending on the temperature. The changes in such a property or properties result in the change of the amount of the ejected recording liquid or the ink supply speed. Therefore, the apparatus includes means for maintaining the temperature of the recording liquid within a predetermined proper range. The use of a temperature sensor and a heating means (temperature keeping heater) are desirable to quickly heat the liquid and to maintain the temperature.

In order to accomplish such a temperature control with high accuracy, the temperature sensor is desirably disposed adjacent to the recording head, more particularly to the ejection heater. When the recording head is of the disposable type, the temperature sensor is preferably mounted on the recording head from the standpoint of easy head exchanging operation.

However, when such a structure is employed, the properties of the temperature sensors are different in the individual recording heads if manufacturing variation occurs in the temperature sensor. If the same control is effected using such temperature sensors, the correct temperature control can not always be expected.

SUMMARY OF THE INVENTION

Accordingly, it is a principal object of the present invention to provide a liquid jet recording apparatus in which the temperature of the recording head is controlled with high precision.

It is another object of the present invention to provide a liquid jet recording apparatus wherein the output of a temperature detecting element of the recording head is corrected to enhance the accuracy of the temperature detection.

It is a further object of the present invention to provide a liquid jet recording apparatus wherein the variations in the temperature detecting elements in the recording heads are corrected.

It is a further object of the present invention to provide a liquid jet recording apparatus wherein the main assembly of the apparatus is provided with a reference temperature detecting element, and an output of a temperature detecting element of the recording head is corrected in accordance with an output of the reference temperature detecting element.

It is a further object of the present invention to provide a liquid jet recording apparatus wherein the recording head is provided with means carrying information representing characteristics of the temperature detecting elements of the recording head, and the information is read when the head is mounted to the main assembly, and in response to the read information, the output of the temperature detecting element is corrected.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 22, 22A–22D illustrate the positional relation between a recording head and a thermis-tor.

FIGS. 30, 30A–30D illustrate a positional relation among a recording head, a thermis-tor and a heater.

DETAILED DESCRIPTION OF THE PREFERRED EMBODIMENTS

Figure 1:
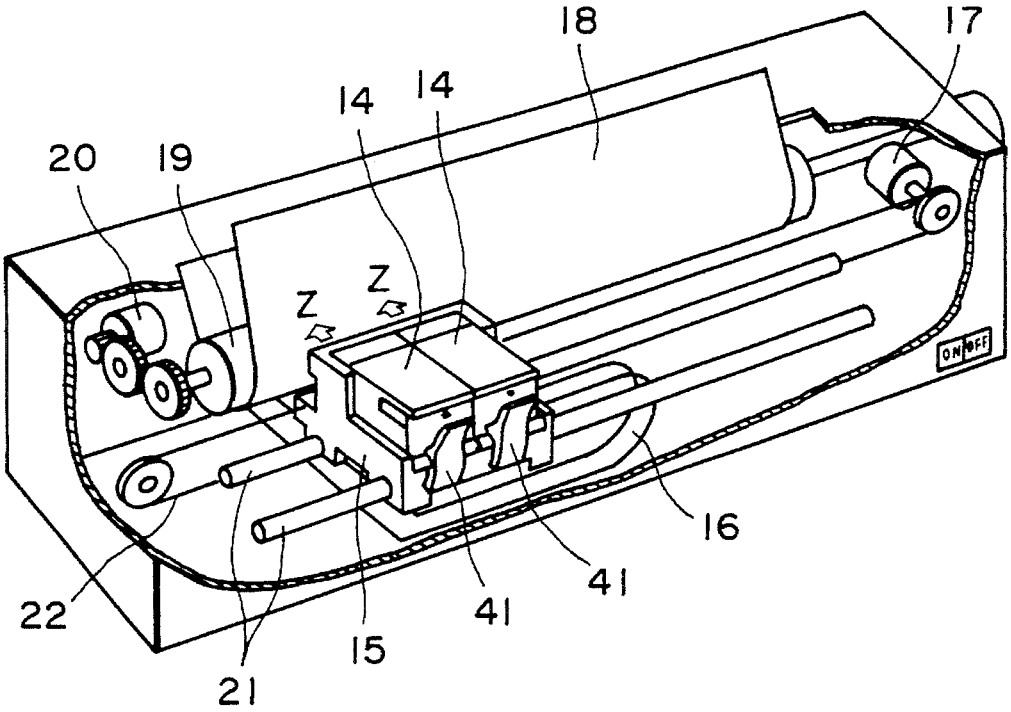
FIG. 1 is a perspective view of an ink jet recording apparatus according to an embodiment of the present invention.
Figure 2:
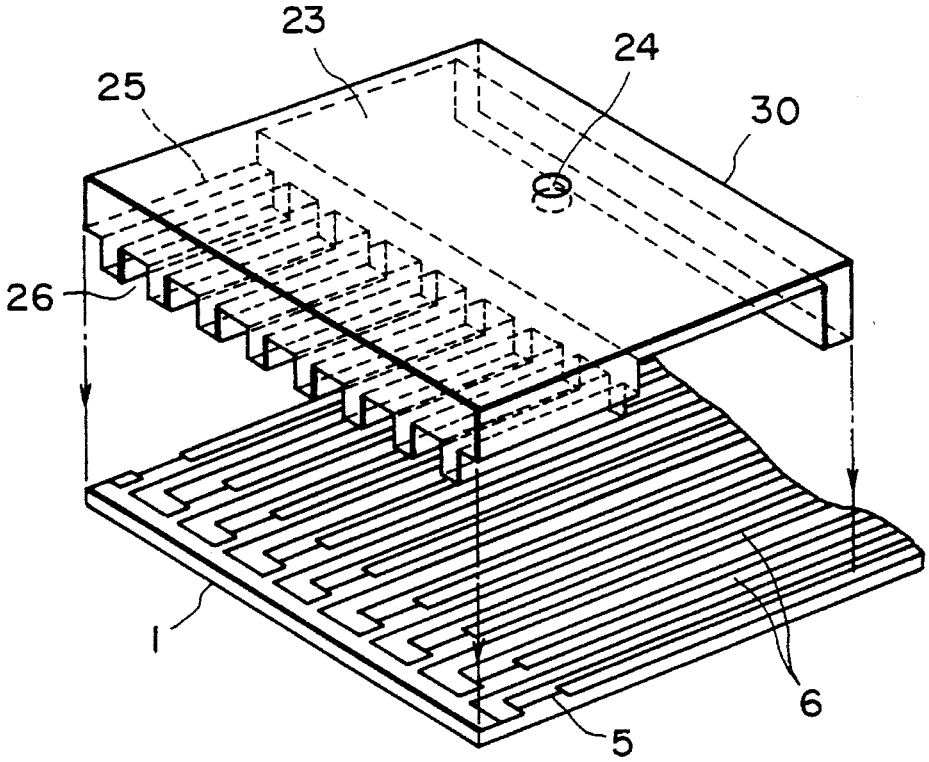
FIG. 2 is a perspective view of a recording head used with the apparatus.
Figure 3A:
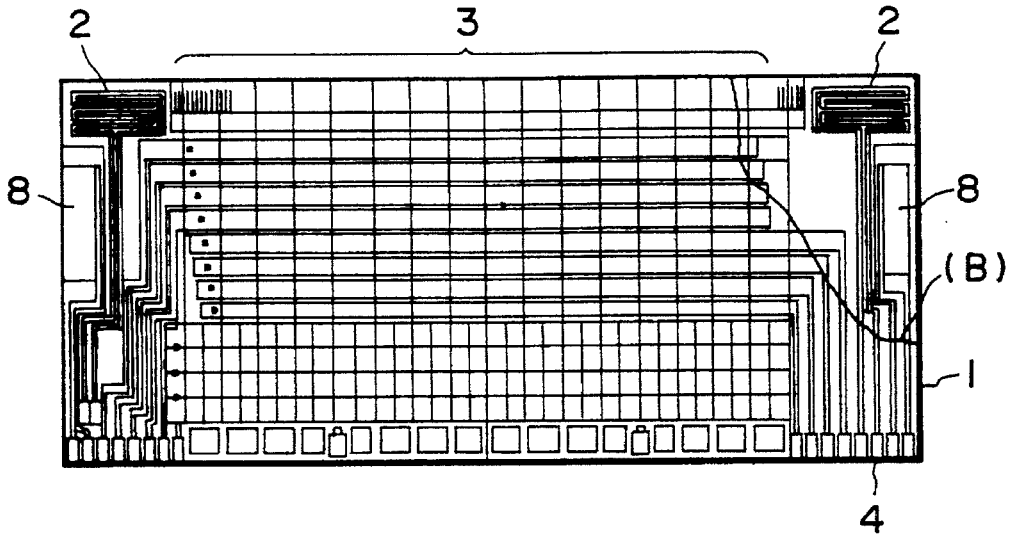
FIGS. 3A and 3B are perspective views of an example of a heater board usable with the recording head shown in FIG. 2.
Figure 3B:
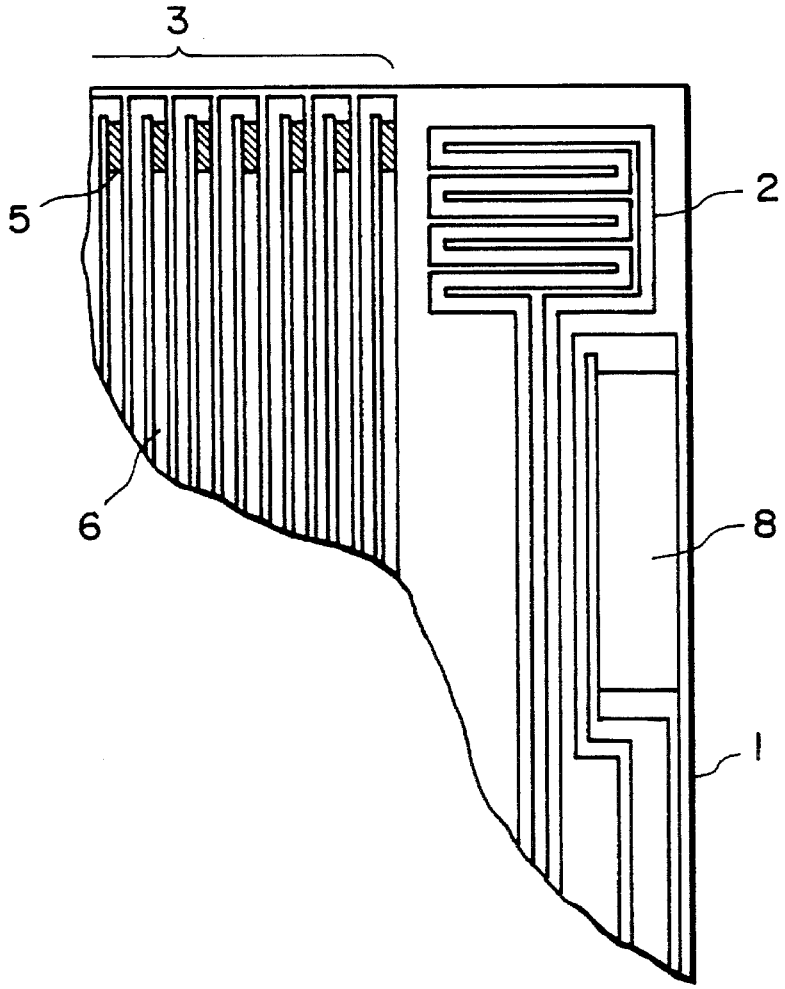

Referring to FIGS. 1, 2, 3A and 3B, there is shown a liquid jet recording apparatus (ink jet recording apparatus) according to an embodiment of the present invention. FIG. 2 shows the structure of a recording head used in the liquid jet recording apparatus, and FIGS. 3A and 3B show an example of a heater board usable with the recording head of FIG. 2.

In FIG. 1, a head cartridge 14 includes as a unit a recording head and a ink container for supplying ink thereto. The recording head includes a heater board shown in FIGS. 2 and 3. The head cartridge 14 is fixedly mounted on a carriage 15 by a confining member 41. The carriage 15 is movable along the length of the shaft 21 together with the head cartridge 14. The ink ejected through the ejection outlet of the recording head reaches a recording medium 18 which is disposed away from the ejection outlet with a small clearance on a platen 19 which is effective to confine the recording surface of the medium. By the ink, an image is formed on the recording medium 18.

To the recording head, ejection signals are supplied in accordance with the image data to be recorded from a proper data source through a cable 16 and through connectors 4 (FIG. 3) connected thereto. Corresponding to the number of colors of the ink, one or more (two in this Figure) of the head cartridges are usable.

In FIG. 1, a carriage motor 17 functions to scanningly move the carriage 15 along the shaft 21. The driving force is transmitted by a wire 22 from the motor 17 to the carriage 15. The recording medium 18 is fed by a feed motor 20 operatively associated with the platen roller 19.

FIG. 2 shows an example of a structure of the recording chip used in this embodiment. It includes a heater board 1, which comprises a silicone substrate, electrothermal transducers (ejection heater) 5 and wiring 6 made of aluminum or the like for supplying the electric power thereto. They are formed by thin film forming technique. The recording head chip is constructed by bonding a top plate 30 provided with partitions for forming recording liquid passages (nozzles) 25, onto the heater board 1.

The liquid (ink) for the recording is supplied to a common chamber 23 through a supply port 24 formed in the top plate, and it is introduced into the nozzles from the common chamber 23. When the heater 5 generates heat by the electric energization, a bubble is formed in the ink filled in the nozzle 25, upon which a droplet of the ink is ejected through the ejection outlet 26.

FIGS. 3A and 3B are a top plan view and an enlarged view of the heater board used in this embodiment.

As shown in FIG. 3A, the heater board includes ejection heaters 3 and contacts 4 which are externally connected by wire bonding. It also includes a temperature sensor 2 functioning as a temperature detecting means, and it is formed adjacent the ejection heaters 3 through the same thin film forming process as the ejection heater 3. FIG. 3B is an enlarged view of a portion B including the sensor 2 in FIG. 3A. Designated by a reference 8 is a temperature keeping heater for heating the head chip.

The sensor 2 as well as the other portion is formed by a thin film forming process as in the semiconductor manufacturing, and therefore, the precision thereof is very high. It may be made of a material having an electric conductivity different in accordance with the temperature, and the material thereof may be the same as a structure material of the other parts, such as aluminum, titanium, tantalum, tantalum pentoxide, niobium or the like. Of these materials, aluminum is usable for the electrodes; titanium may be used between a heat generating layer constituting the electrothermal transducer and an electrode therefor to improve the bonding property; and tantalum may be used to improve an anti-cavitation property of the protection layer on the heat generating resistor layer. In order to reduce the variation of the pressing in this apparatus, the width of the lines is increased, and in order to reduce the influence of the wiring resistance or the like, a meandering structure is used to increase the electric resistance.

Similarly, the temperature keeping heater 8 may be made of the same material as the heat generating resistance layer of the ejection heater 5 ($HfB_2$, for example), but it may be made of another material constituting the heater board (such as aluminum, tantalum or titanium).

Now, the temperature controlling operation of the recording head in this embodiment will be described.

In the recording head chip shown in FIG. 2, the temperature sensors 2 are provided adjacent the opposite ends of the heater board 1, as shown in FIG. 3, and therefore, a temperature distribution of the substrate in the direction in which the nozzles 25 are arranged can be known from outputs of the temperature sensors. In addition, since the temperature keeping heaters 8 are disposed adjacent to the temperature sensors 2, the temperature change by the heaters can be quickly detected.

The process of manufacturing the heater board may include a wet etching process, similarly to the semiconductor manufacturing system. In such a case, opposite end portions of the ejection heater 3 are etched more because the circulation of the etching liquid is better there, with the result of the liability that the outputs of temperature sensors 2 vary in the individual recording heads due to manufacturing variations in the temperature sensors 2. Therefore, correct temperature detection is not expected.

In consideration of the above, the recording head in the head cartridge 14 has information relating to the temperature sensor or sensors 2 contained in the recording head. The information is read by the main assembly of the recording apparatus, and the output or outputs of the temperature sensor are corrected to provide correct temperature.

Figure 4:
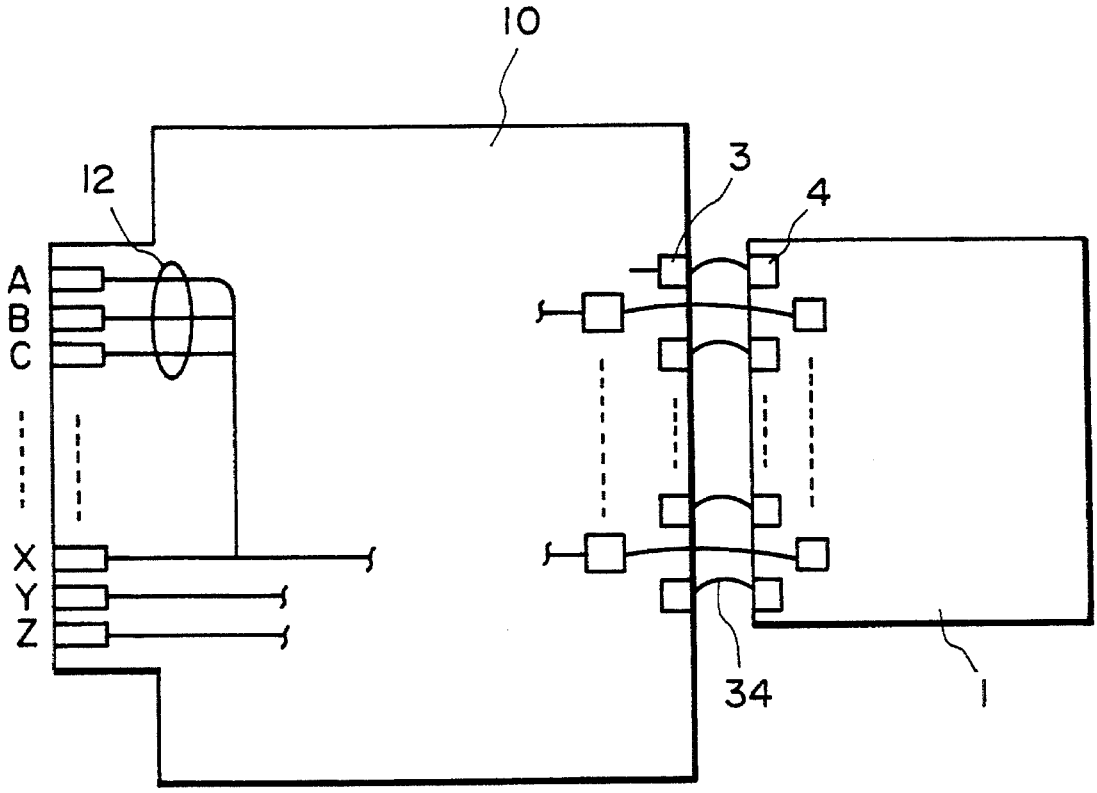
FIG. 4 illustrates the major part of the recording head in this embodiment.

FIG. 4 shows the structure of the major portion of the recording head for producing the information.

A print board 10 on which a wiring pattern or the like for the heater board 1 is formed has contacts A–Z for establishing electric connection with the main assembly and bonding pads 3 for establishing electric connection with the heater board 1 through the bonding wire 34. In the print board 10, the contacts A–C are connected to a grounding contact X. The wiring patterns for the connection can be cut at the portion 12. The portion 12 is cut, in accordance with ranking of the temperature sensor 2, by a laser beam or the like on the basis of results of shop inspection and tests.

Figure 5:
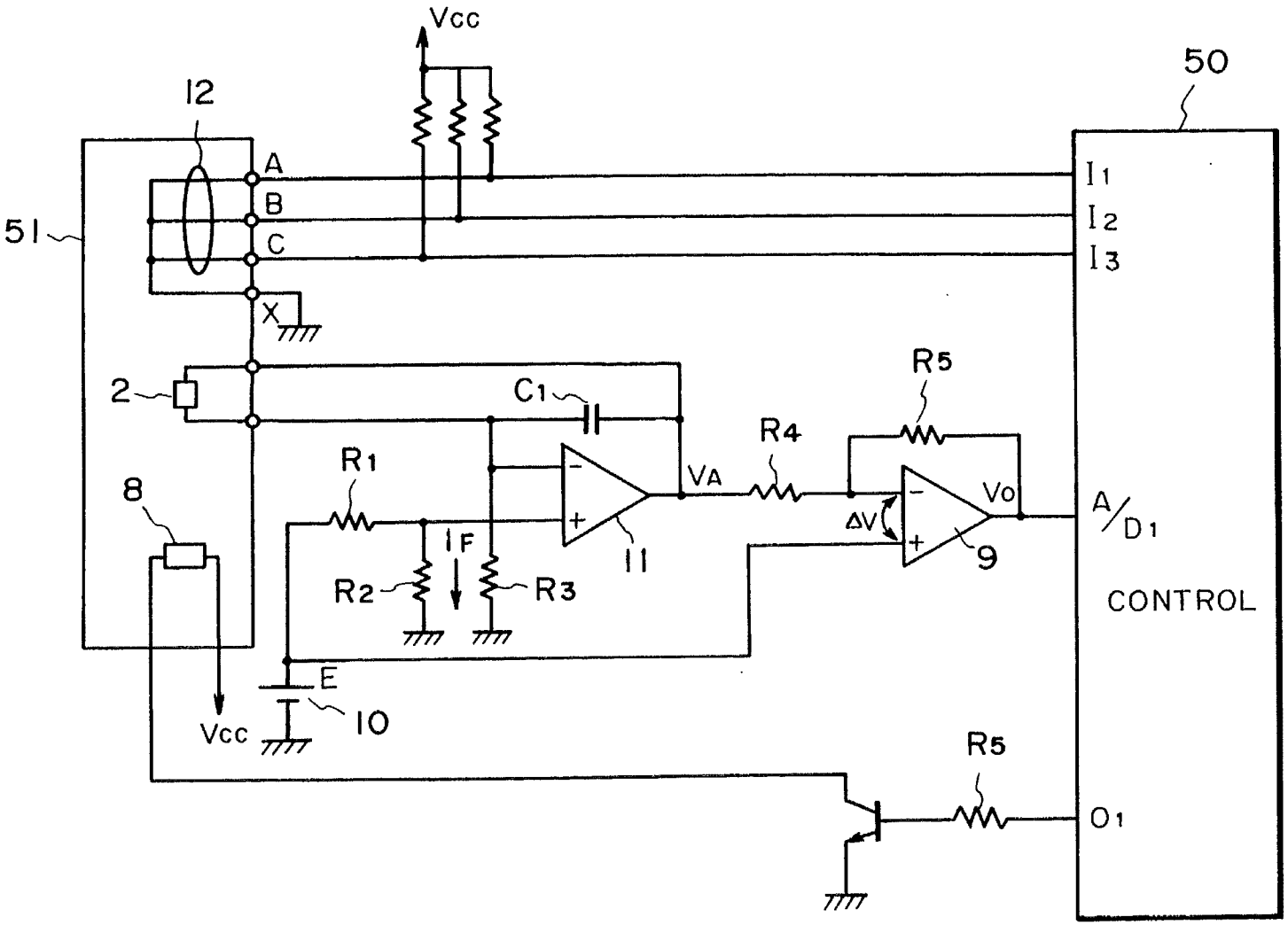
FIG. 5 is a block diagram illustrating the main part of the control system for the apparatus according to this embodiment.

FIG. 5 shows an example of a control system for this embodiment. A controller 50 which may be used also as a main controller of the recording apparatus includes a CPU for executing the process steps which will be described hereinafter in conjunction with FIGS. 5 and 6, ROM storing fixed data such as programs corresponding to the process steps and a table of temperature data corresponding to the outputs of the temperature sensor, RAM for storing correction data or the like and an electric power source for energizing the heater or the like.

Designated by a reference numeral 51 in this Figure is a recording head which is build in the head cartridge of a disposable type shown in FIGS. 2 and 3, and it includes the recording head chip and the print board 11 shown in FIG. 4.

The controller further includes a reference voltage source 10 and an amplifier constituting a constant current source for providing a constant current to the temperature sensor 2. The current $I_F$ is:

$$I_F=(E/R3)(R2/(R1+R2)) \quad (1)$$

An amplifier 9 after the amplifier 11 functions to multiply the difference between the reference voltage E and the output VA of the first amplifier by (R5/R4), and the output Vo thereof is:

$$Vo=E+(R5/R4)(E-VA) \quad (2)$$

However, the values provided by equations (1) and (2) are theoretical values provided by ideal amplifiers. Actually, however, there is an off-set voltage ΔV in the amplifier 9 in FIG. 5, in consideration of this, the equation (2) is modified as follows:

$$Vo'=E+(R5/R4)(E+\Delta V-VA) \quad (3)$$

Therefore, the output voltage Vo is changed by (R5/R4)ΔV, that is, by the offset voltage multiplied by the gain.

The resistance of the temperature sensor which is the meandering pattern of aluminum shown in FIG. 3 is determined by the total length and the pattern width thereof, as follows:

$$R=\gamma(L/W)$$

That is, it is proportional to the total length and is reversely proportional to the width of the pattern. In the above equation, γ is a constant. Therefore, in this example, the pattern functioning as the sensor has the length L or the width W such that the temperature detection can be easily carried out.

Figure 6:
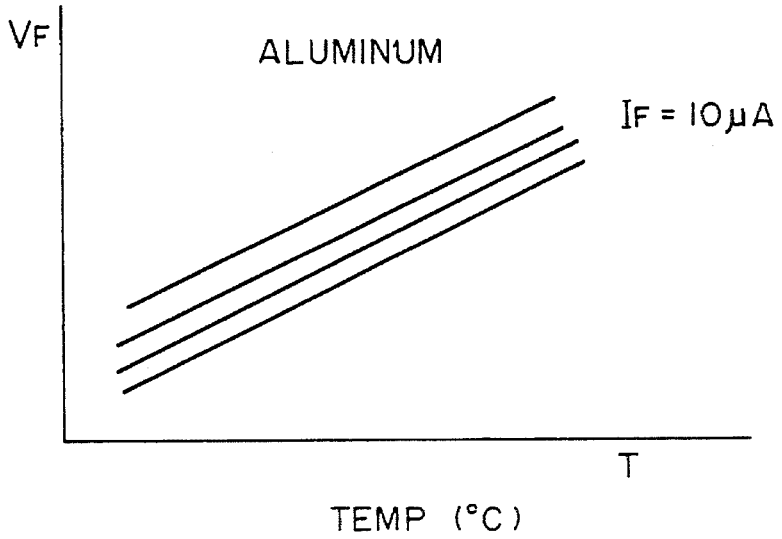
FIGS. 6 and 7 show a thermal property and a circuit output property of a resistor pattern of aluminum usable as a temperature sensor.

FIG. 6 shows a temperature property of aluminum. As will be understood, the property is such that when a constant current $I_F$ flows through aluminum, the resistance increases with the temperature increase, and therefore, the voltage drop $V_F$ between the opposite ends increases.

When a meandering wiring pattern of aluminum is used as a temperature sensor, the temperature dependency of the voltage drop thereof is used. However, even if the rate of change relative to the temperature is the same, there are variations depending on lots, as shown in FIG. 6.

Figure 7:
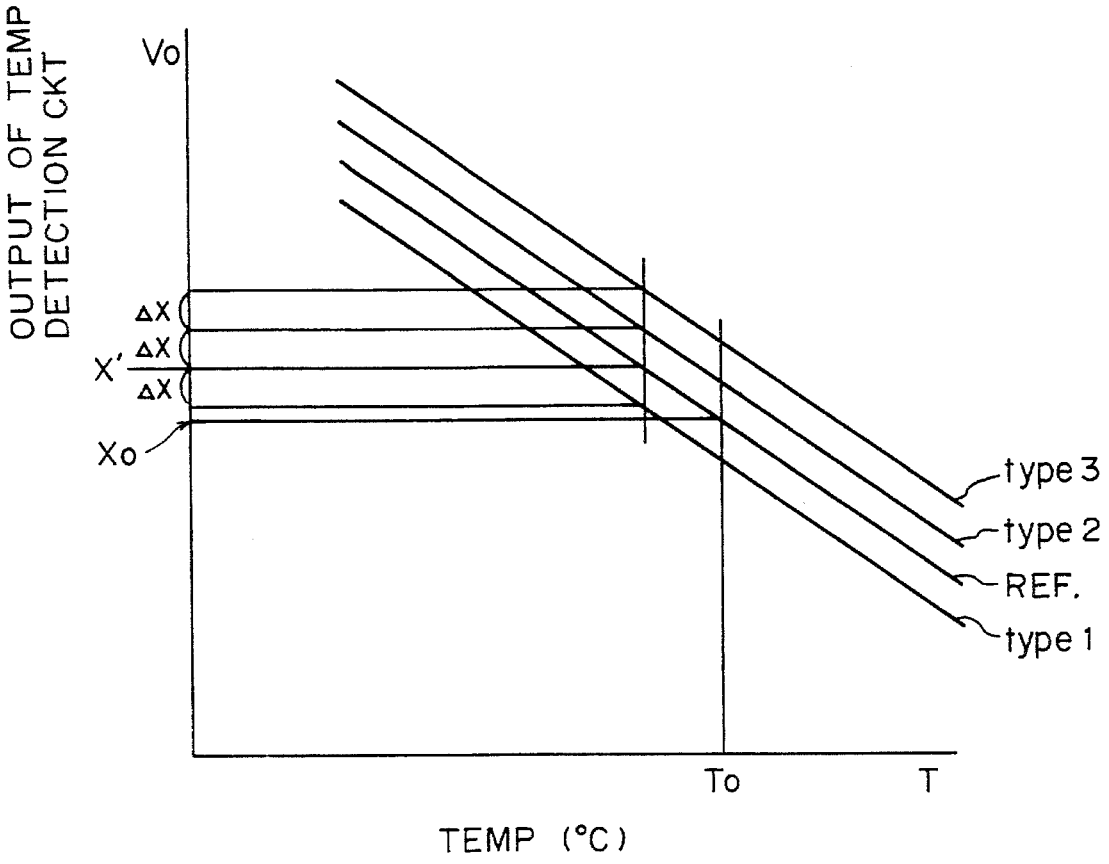

As shown in FIG. 7, the output Vo of the temperature detecting circuit using such a temperature sensor goes down rightwardly, but the inclination thereof is constant since it depends on the property of aluminum. In this embodiment, the various parameters of the temperature control system in the main assembly of the apparatus is determined on the basis of a characteristic curve providing a predetermined output (Xo) for a predetermined temperature (To °C., for example), and a plurality of such characteristic curves is classified to several groups based on differences from the reference curve. In FIG. 7, they are classified into four groups, namely, "reference", "type 1", "type 2" and "type 3". When the sensor has the reference characteristics, the main assembly does not correct the output thereof, and the output as it is used as a temperature determining datum. In the case of the other groups, the output is corrected by adding or reducing an integer multiple of ΔX, and then the corrected output is used as a temperature determining datum. More particularly, in the example of FIG. 7, an output of "type 1" sensor is corrected by adding ΔX to its output; the output of "type 2" sensor and the output of "type 3" sensor, are corrected by reducing ΔX and 2ΔX from its output, respectively. The corrected outputs are used for the temperature determining data.

When the information representing the characteristics of the temperature sensor 2 is provided on a recording head having a structure shown in FIGS. 3 and 4, the temperature characteristics of the temperature sensor 2 are determined during the inspection of the recording head, and the temperature sensor is ranked into that one of the groups shown in FIG. 7 which has the characteristics closest to the determined characteristics. In accordance with the determined rank, the portion 12 shown in FIG. 4 is properly cut.

In FIG. 5, if the pattern is not cut at all, the input port of the controller 50 receives L level, and if it is cut, it receives H level signal. Therefore, the controller 50 discriminates the level of the signals received by the input ports I1–I3, and the ranking of the temperature sensor can be discriminated, accordingly, the following table shows an example.

| | Input Port | | |
|---|---|---|---|
| Sensor Rank | $I_3$ | $I_2$ | $I_1$ |
| Reference | L | L | L |
| Type 1 | L | L | H |
| Type 2 | L | H | L |
| Type 3 | L | H | H |

Since the portion 12 where the pattern is cut has a three-bit structure, the temperature sensor can be classified into 8 groups ($2^3$=8), rather than classifying into four groups. If this is done, the correction unit ΔX can be made smaller, or the correctable range can be expanded. The number of groups may be not limited to four, but may be any number, and the bit structure of the pattern to be cut can be properly determined.

Figure 8:
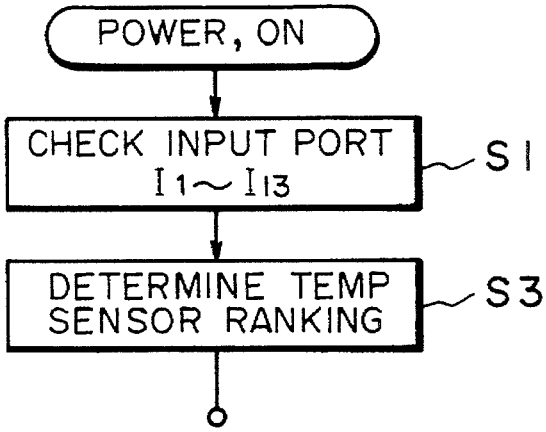
FIG. 8 is a flow chart showing an example of a rank determining process for a temperature sensor.

FIG. 8 shows the process steps for determining the ranking of the temperature sensor, and the process steps can be carried out when the main switch is closed, or when the head cartridge 14 is exchanged.

When the process is started, the input ports I1–I3 are checked at step S1. Depending on the checking, the rank of the temperature sensor 2 is determined in accordance with the table described in the foregoing, and the rank is written in a predetermined address of the RAM of the controller 50, for example. This permits the correction of the output of the temperature sensor 2 in accordance with the rank.

In this embodiment, the temperature sensors 2 are provided at the opposite end portions of the ejection heater 3, and therefore, the process of FIG. 8 is carried out for the respective sensors.

Figure 9:
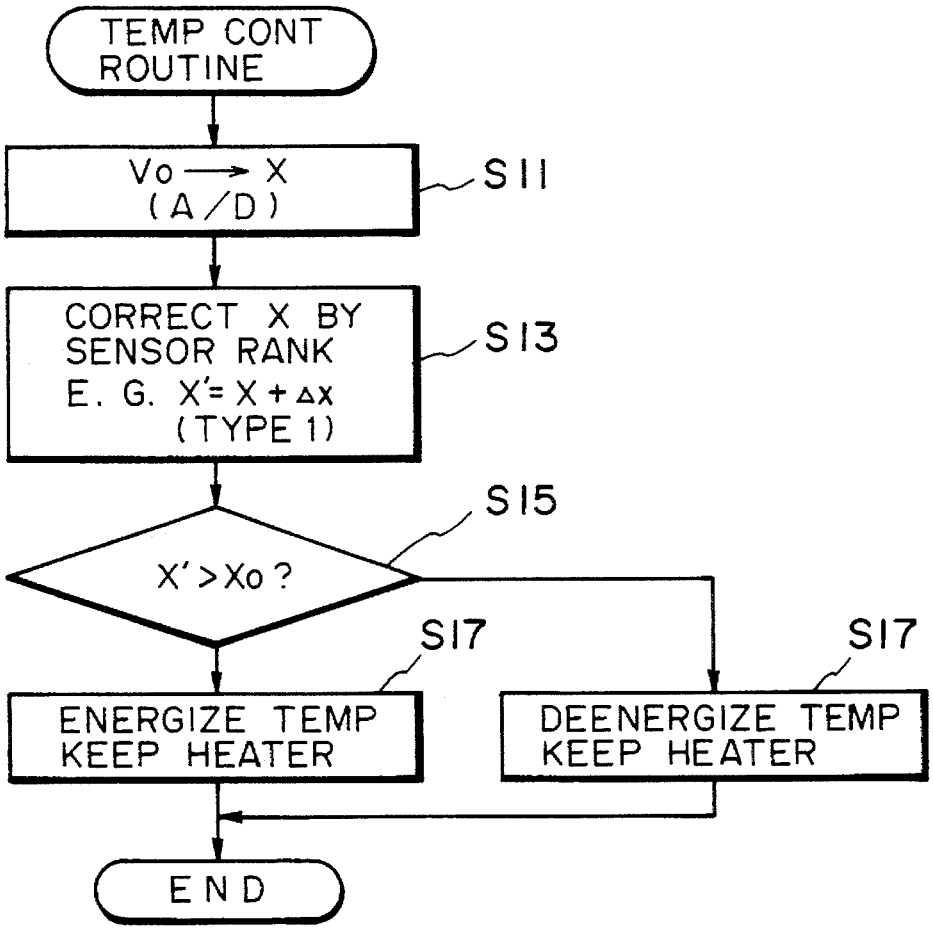
FIG. 9 is a flow chart of an example of a temperature controlling process in accordance with the rank.

FIG. 9 shows an example of the temperature control using the temperature sensor which has been ranked in the manner described above. At step S11, the output Vo (an input of A/D converter A/D 1) of the amplifier 9 is A/D-converted, and the converted value X is corrected to X' on the basis of the rank information stored by the process of FIG. 8 (step S13). For example, if the temperature sensor 2 is the "type 1" sensor, the output is added by ΔX.

After the corrected output X' is determined, it is compared with a set level Xo at step S15, and the temperature keeping heater is on-off controlled at step S17. Thus, in this embodiment, the temperature control is more accurate.

In the foregoing description, the temperature sensor 2 is a resistor pattern of aluminum, but the material may be another. In addition, it may be a diode or diodes rather than a resistor pattern.

Figure 10:
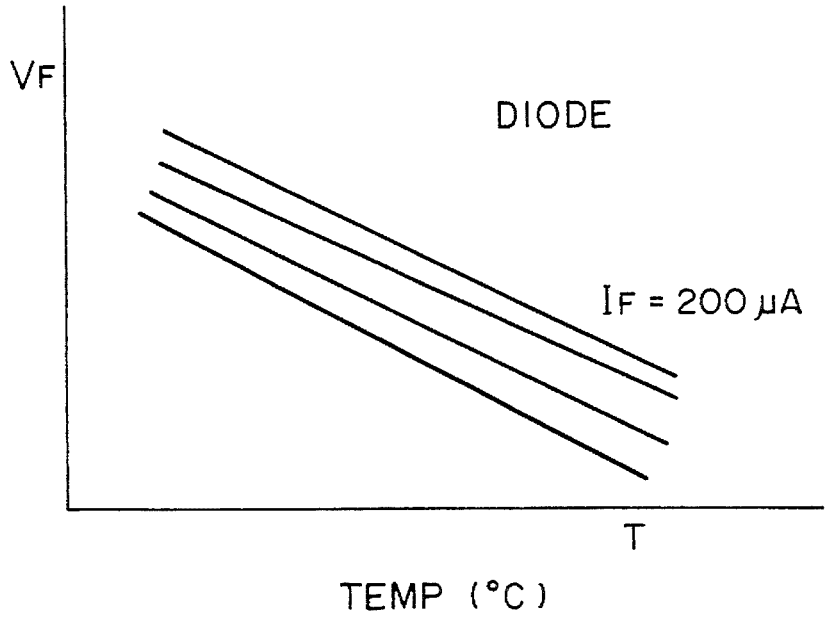
FIGS. 10 and 11 show a circuit output property and a thermal property of a diode usable as the temperature sensor.

When a diode is utilized as a temperature sensor, the temperature dependency of the forward voltage drop of the diode is used. Even if the rate of change of the voltage drop relative to the temperature is the same, there are variations depending on lots, as shown in FIG. 10.

Figure 11:
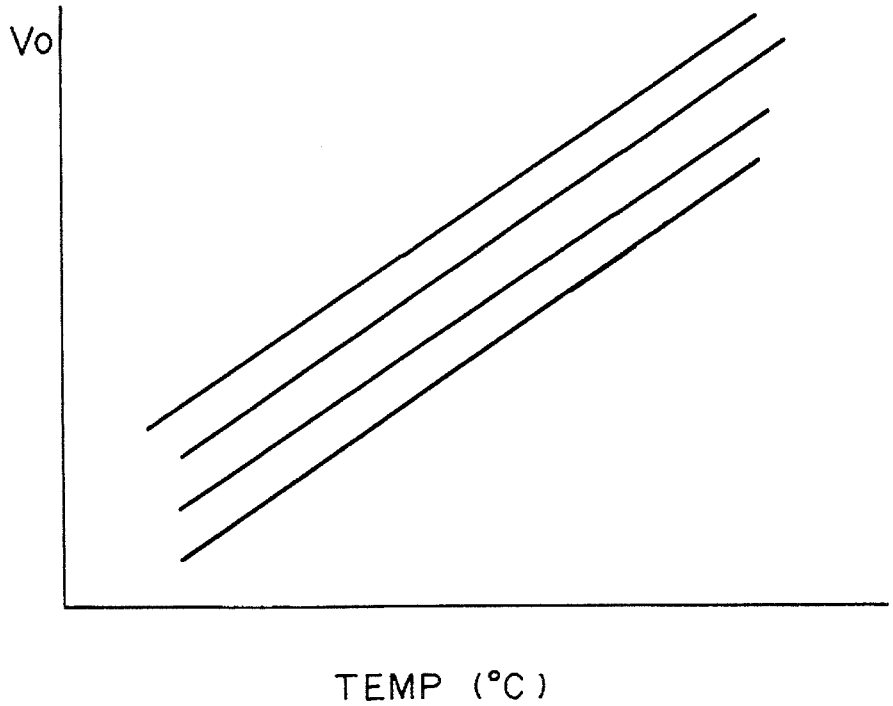

As shown in FIG. 11, when the diode is used as the sensor, the output voltage Vo increases linearly with the rise of the temperature. Actually, however, there are variations from the ideal line A. What is important here, however, is the inclination α of the line is determined by the property of the sensor, and the variation in the inclination is within 1% in a semiconductor devices such as diodes.

Therefore, when the diode is used, the correction depending on the ranking similarly to the above-embodiment is possible, by which the temperature control is more accurate.

The foregoing description has been made with respect to the liquid jet recording apparatus using a head cartridge containing as a unit the recording head and the ink container, but the present invention is applicable to the case wherein they are separate, and the ink container is not necessarily disposable.

The temperature sensor 2 may be in the form of a thermistor, a diode, a transistor or another. The temperature sensor 2 may be simultaneously formed with the ejection heater 5 on the heater board 1, or it may be formed separately. In addition, it is not limited to a sensor or sensors formed on the heater board 1. A proper number of the temperature sensors may be disposed at proper positions in the recording head.

Furthermore, the present invention is not limited to a serial recording type apparatus, if it uses a recording head or a head cartridge of a disposable type.

As described in the foregoing, even if the properties of the temperature sensors of the recording heads are varied, the corrections may be properly made to permit correct temperature control.

Figure 12:
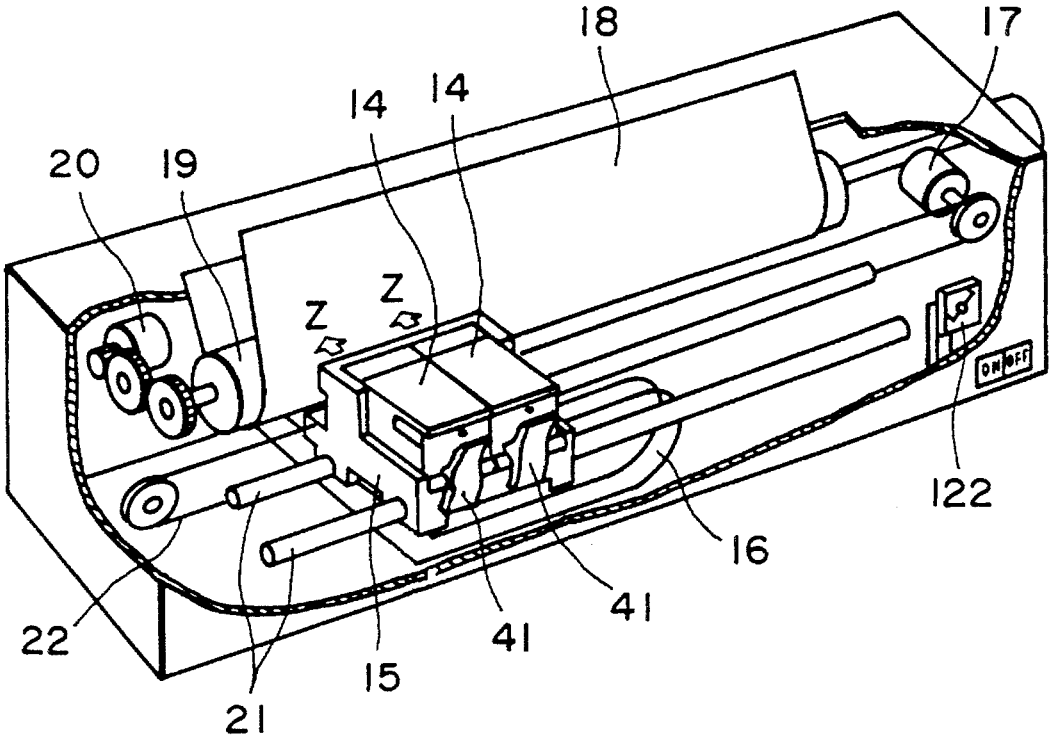
FIG. 12 is a perspective view of an ink jet recording apparatus provided with a reference temperature sensor in the main assembly thereof.

It is a possible alternative that a reference temperature sensor is provided in the main assembly of the apparatus, and when the recording head cartridge is first mounted, an output of the temperature sensor in the recording head is corrected on the basis of the output of the reference temperature sensor. Referring to FIG. 12, an embodiment of this type will be described. FIG. 12 shows a structure of the ink jet recording apparatus of this embodiment. In this FIG., the same reference numerals as in FIG. 1 are assigned to the elements having the corresponding functions. The main assembly includes a reference temperature sensor 122 disposed at a proper position of the main assembly, which functions to provide a reference for the correction of the output of the temperature sensor which will be described in detail hereinafter. The reference temperature sensor 122 is disposed at a proper position which is not influenced by the temperature rise in the main assembly, and functions to monitor the ambient temperature.

Figure 13A:
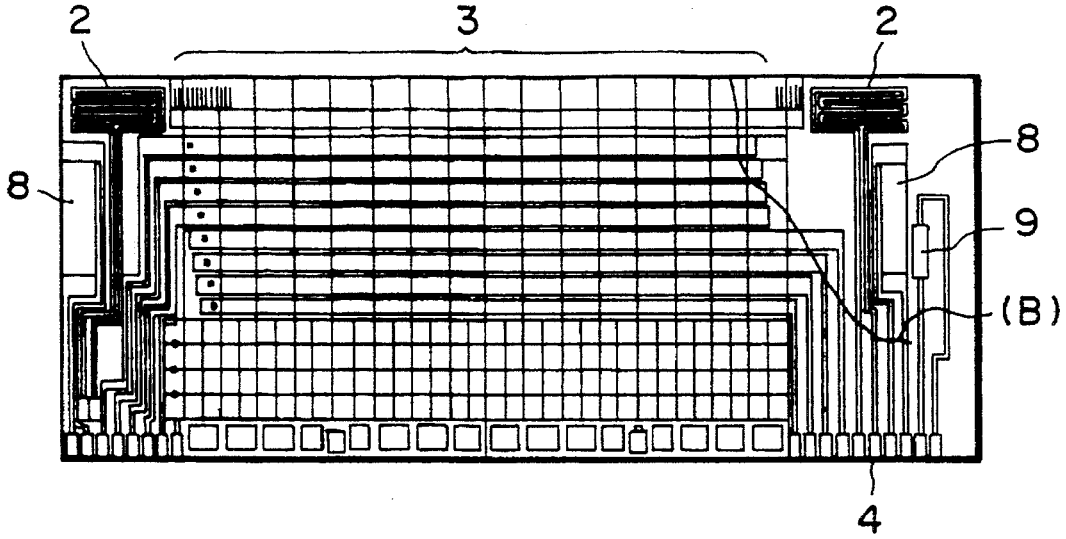
FIGS. 13A and 13B are perspective views of an example of a heater board usable with the recording head of FIG. 12.
Figure 13B:
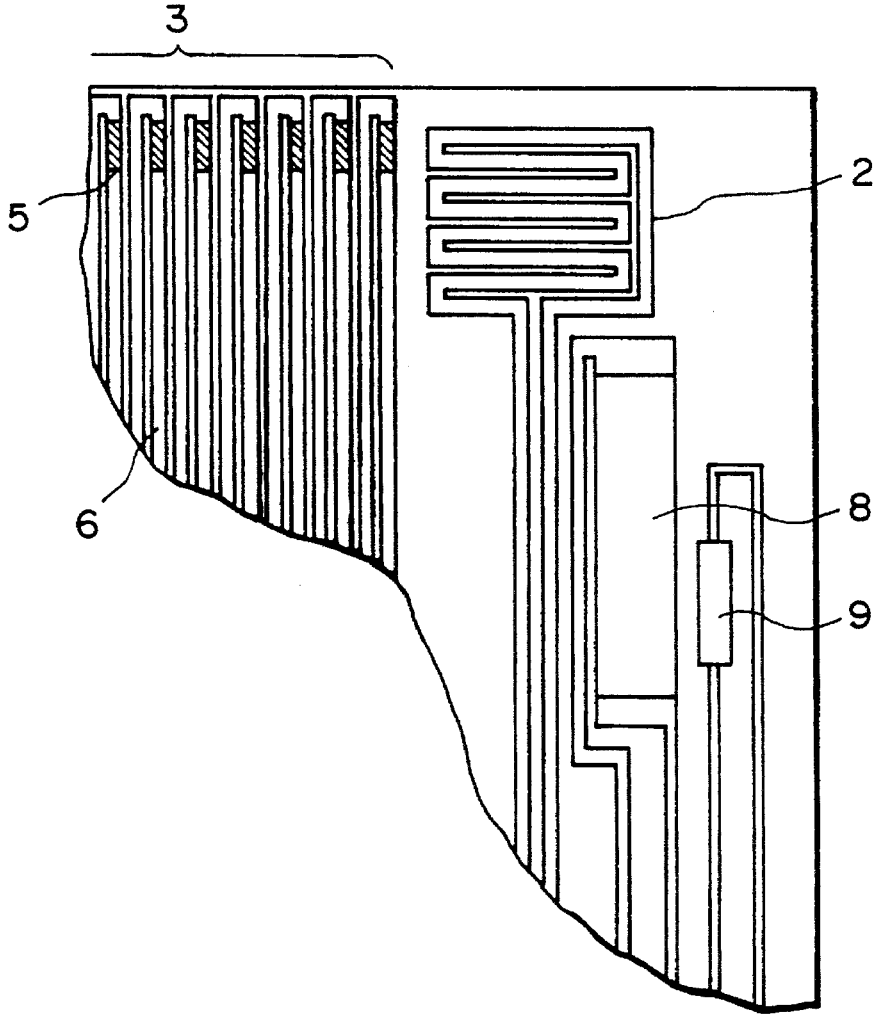

FIGS. 13A and 13B are a top plan view and an enlarged partial view of a heater board used in this embodiment. It includes a resistor pattern 9 which can be cut by a small current, and it is used for determining timing of the temperature sensor 2 correction.

The other structures of the recording head are the same as shown in FIG. 2 and 3, and therefore, the detailed description is omitted for simplicity.

Figure 14A:
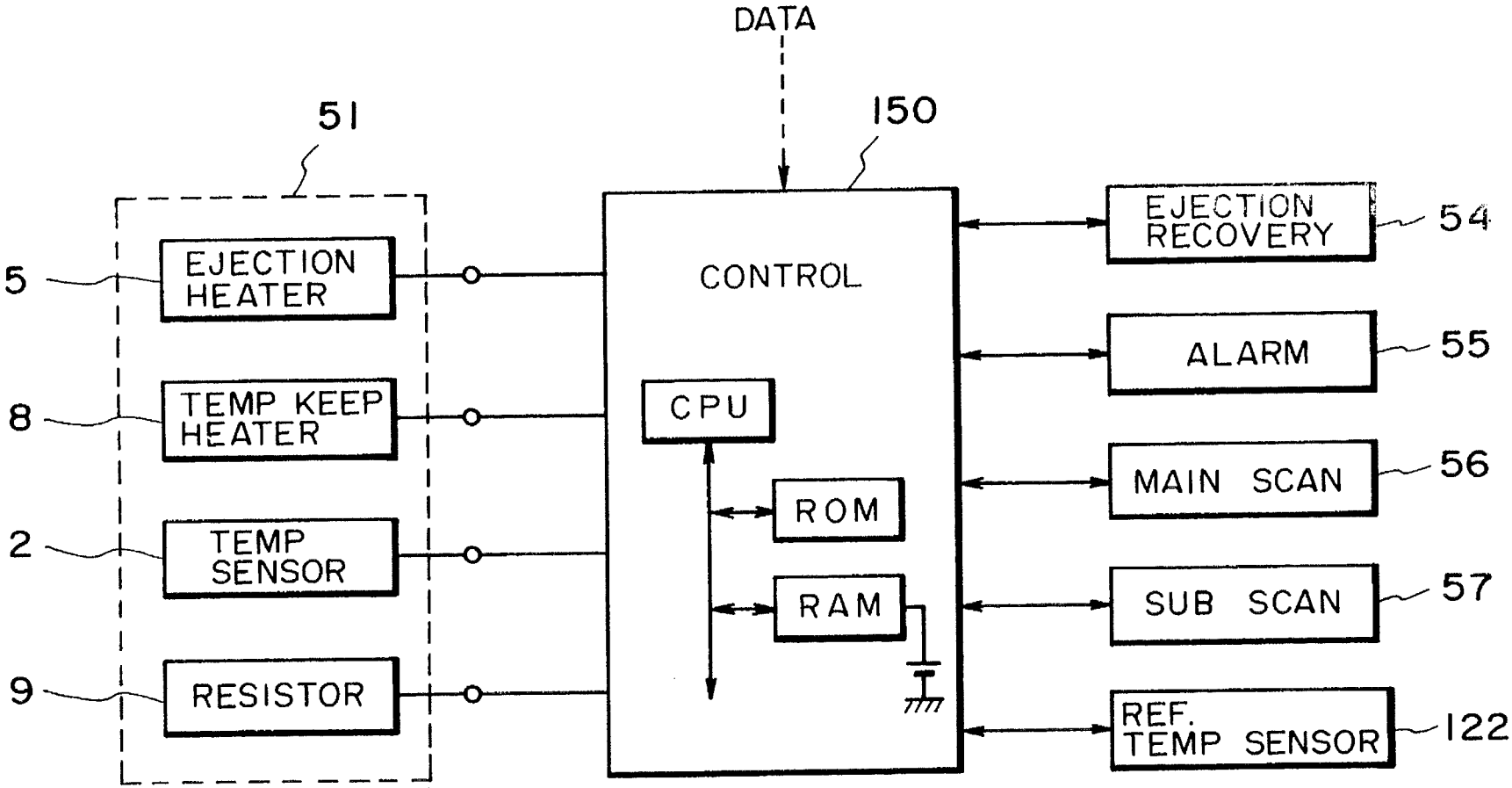
FIG. 14A and 14B are a block diagram of a control system for controlling an output of the temperature detecting element of the recording head in accordance with an output of a reference temperature sensor and a block diagram showing in detail the major part thereof, usable with the apparatus of this embodiment.

FIG. 14A shows a schematic structure of an example of the control system in this embodiment. The control system includes a main controller 150. The main controller 150 includes a CPU for executing the process steps which will be described in detail hereinafter in conjunction with FIGS. 5 and 6, a ROM for storing fixed data such as a program corresponding to the process steps and a table of temperature data corresponding to an output of the temperature sensor, and a RAM for storing correction data or the like and an electric power supply source for supplying electric power to the heater or the like. In this embodiment, the controller is backed up by battery or the like even if the main switch of the main assembly is opened, so that the memory in the RAM, particularly the correction data, is not lost.

The recording head built in the disposable type head cartridge described in conjunction with FIGS. 2 and 3 is designated by a reference numeral 51. Designated by a reference numeral 54 is an ejection recovery device which comprises a capping device disposed outside the recording range in FIG. 12, for example, at a home position of the carriage 15 or the recording head 51, where it is not opposed to the recording head 51, and a suction mechanism for drawing the ink through the ink ejection outlets of the recording head 51, with the suction mechanism communicating with the capping device.

An alarming device 55 includes a display device such as an LED or the like or a sound generator such as buzzer, or a combination thereof. A main scanning mechanism scanningly moves the carriage 15 during the recording operation and includes a motor 17 or the like. A subordinate scanning mechanism 57 includes a motor 20 or the like for feeding the recording material.

Figure 14B:
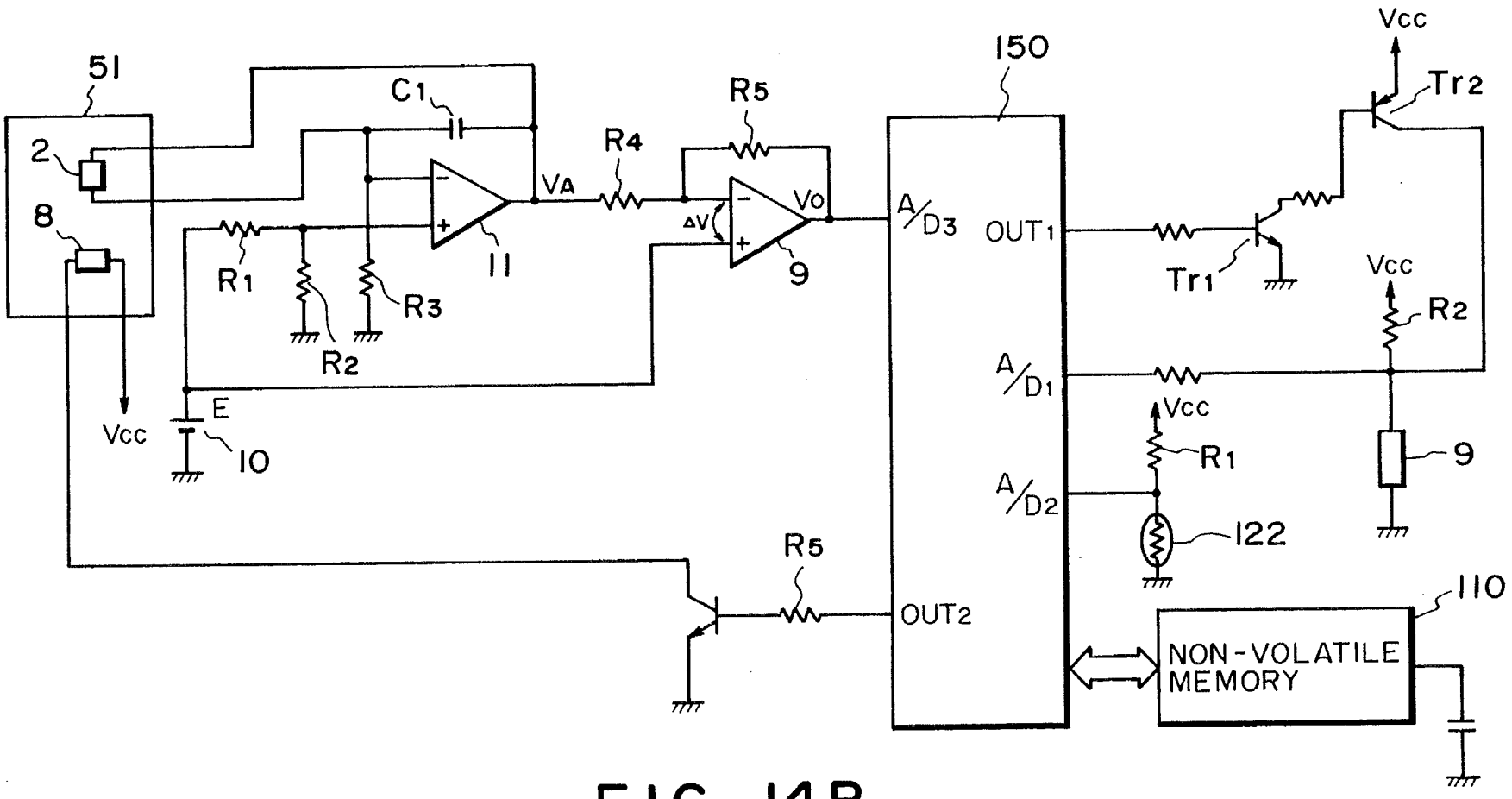

FIG. 14B shows details of the major parts of the above structure. Reference numerals 51 designates the recording head; 8, a temperature keeping heater; 2, a temperature sensor such as a meandering resistor of aluminum or a diode; and 10, a reference power source. An amplifier 11 constitutes a constant current source for applying a constant current to the temperature sensor 2. The current flowing therethrough $I_F$ is as defined by the above mentioned equation (1). The output Vo of the amplifier 9 is as defined by the equation (3).

When a diode is used as the temperature sensor, the temperature dependency of the forward voltage drop of the diode is used. Even if the rate of the change relative to the temperature is constant, there are variations depending on lots or the like, as shown in FIG. 10.

Figure 15:
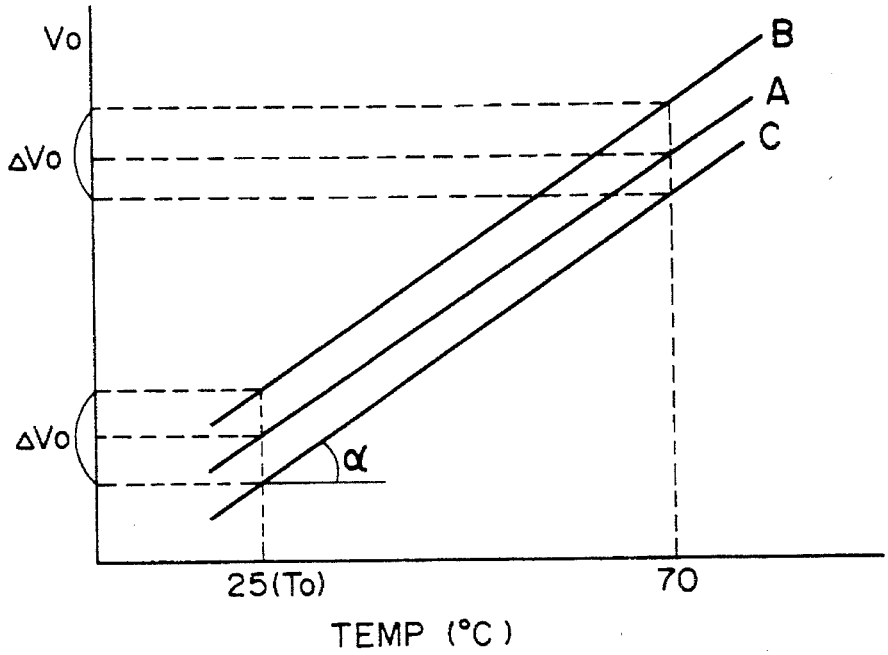
FIG. 15 shows a circuit output property when a diode is used as the temperature sensor.

Referring to FIG. 15, when the diode is used as the sensor, the output voltage Vo linearly increases with the increase of the temperature. However, there is variation within a with of ΔVo, actually, from the ideal line A. However, what is important here is that the inclination α of the line is determined by the property of the sensor, and the variation in the inclination is within 1% in semiconductor devices such as diode.

Accordingly, in the temperature control system of this embodiment, an A/D conversion rate of the output Vo at a predetermined temperature is written in a non-volatile memory 110 (RAM or the like backed up battery). On the basis of this, an output of the temperature sensor 2 is corrected to provide correct temperature determination.

Figure 16:
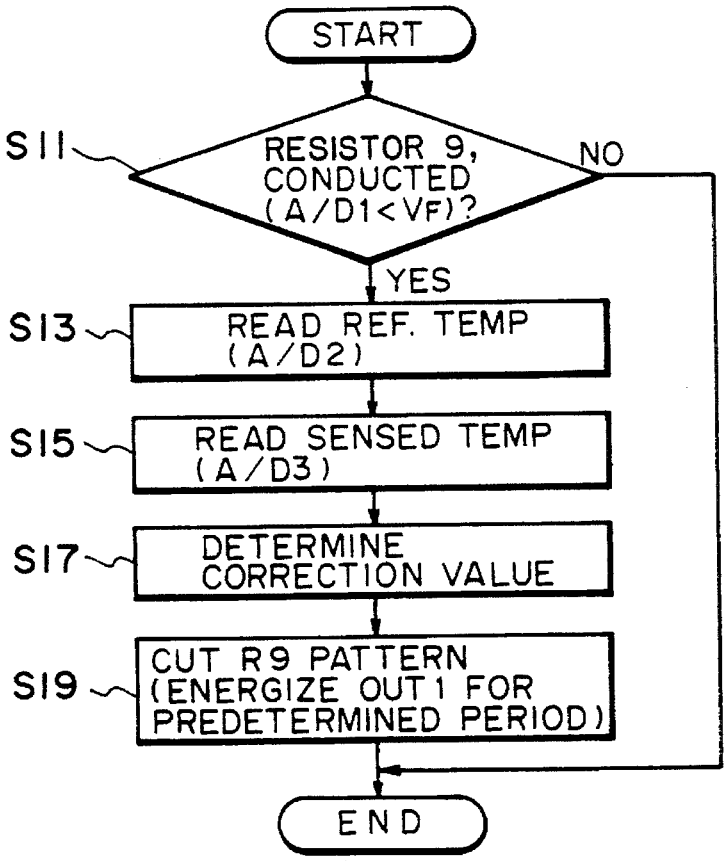
FIG. 16 is a flow chart showing process steps for determining the correction for the sensor.

FIG. 16 shows the process steps for determining the correction value in the structure shown in FIGS. 14A and 14B. This process is started when the main switch is closed, or when the head cartridge 14 is exchanged. In this embodiment, it is started upon the exchange of the head cartridge.

When this process starts, the resistor 9 is supplied with a small amount of electric power so as not to break it, and the electric conductance is checked by, for example, discrimination of whether or not the digital level corresponding to the analog level received by an input terminal A/D 1 from the resistor 9 is smaller than a predetermined level $V_F$. If the head cartridge 14 is fresh, the result of the discrimination is affirmative, and step S13 is carried out. At step S13, an output of the reference temperature 122, more particularly, a digital level corresponding to the analog level received by an input terminal A/D 2 of the reference temperature sensor 122, is read to determine the ambient temperature To. Then, at step S15, an output of the temperature sensor 2 on the heater board 1 of the recording head 51, or more particularly, a digital level corresponding to the voltage Vo received by an input terminal A/D 3 in FIG. 14B is read, and temperature datum corresponding to the output is determined. At step S17, the correction value Xo for the sensor 2 is determined from the temperature data determined by the outputs of the reference sensor 122 and the sensor 2. The correction value Xo is stored in a predetermined address of the RAM. In this embodiment, temperature sensors 2 are disposed at the opposite sides of the heater board 1, and therefore, the correction values are determined for the respective sensors 2 and are stored in a non-volatile memory 110 (FIG. 14B) of the RAM of FIG. 14A.

At step S19, an amount of electric current so as to break the resistor 9 is supplied, by producing an output OUT1 for a predetermined period in FIG. 14B, thus cutting the pattern. By doing so, the process (steps S13–S17) for determining the correcting value is no longer executed for the same head cartridge, so that wasteful processing is avoided and the overall printing speed is increased.

Figure 17:
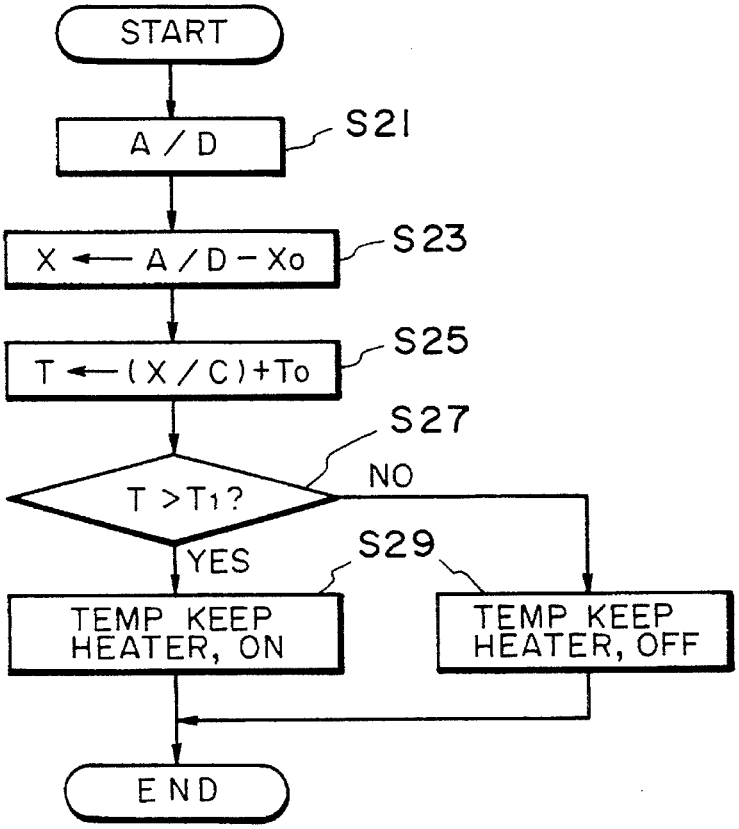
FIG. 17 is a flow chart showing an example of a temperature controlling process.

FIG. 17 shows a temperature control process using the correction value obtained through the above process. At step S21, an output Vo (an input of A/D 3) of the amplifier 9 is A/D-converted. At step S23, from this value (the A/D converted value of the input of A/D 3), the predetermined temperature (To) stored in the non-volatile memory 110 through the process shown in FIG. 16, for example the A/D value (an input of the A/D 2) Xo at 25° C. for example, is detected. The reference X is divided by an output change C [V/°C.]/1° C. corresponding to the inclination α of the line, and the actual temperature change from the predetermined temperature (To) is calculated at step S25. Through the above steps, the current temperature T is determined. When the temperature T is determined in this manner, the temperature keeping heater can be on-off controlled at step S29, on the basis of comparison with the set temperature T1 (step S27). In this embodiment, the temperature control is more accurately performed.

Figure 18:
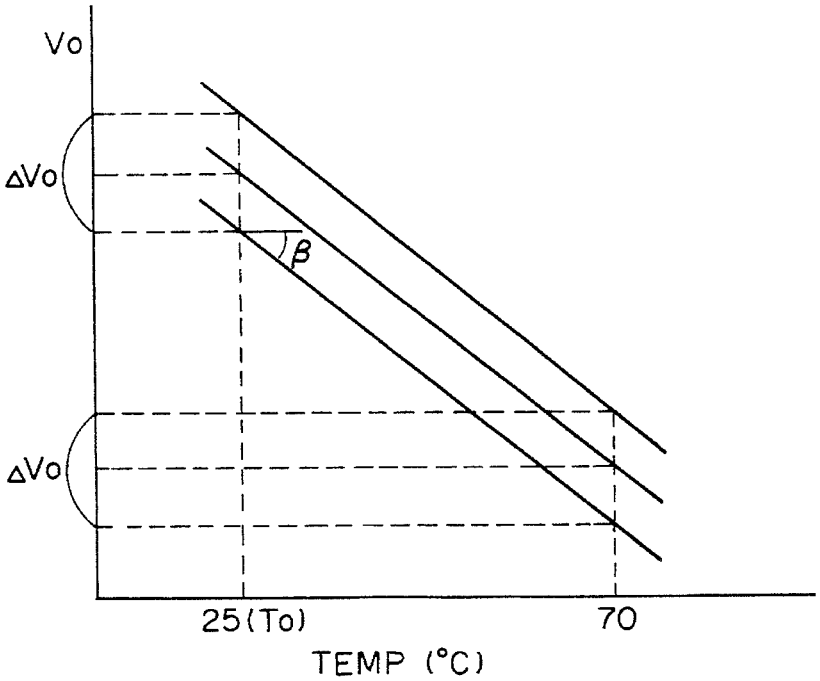
FIG. 18 shows a circuit output property of a temperature sensor when a resistor pattern of aluminum is used for the temperature sensor.

When the temperature sensor is the meandering pattern of aluminum shown in FIG. 3, the temperature dependency of the aluminum is as shown in FIG. 6. In this case, the circuit output Vo is a line going down rightwardly, as shown in FIG. 18. Here, the inclination α is constant due to the property of the aluminum. Therefore, similarly to the case of the diode sensor described in the foregoing, the A/D converted value of the output Vo at the predetermined temperature (To) is written in non-volatile memory, by which the temperature control can be performed with the circuit error corrected, through the similar control process.

In the foregoing embodiment, the correction value determining process is executed only when a fresh recording head 51 or head cartridge 14 is mounted to increase the overall recording speed, but such a process may be performed at a desired time when the recording operation is not carried out.

Figure 19:
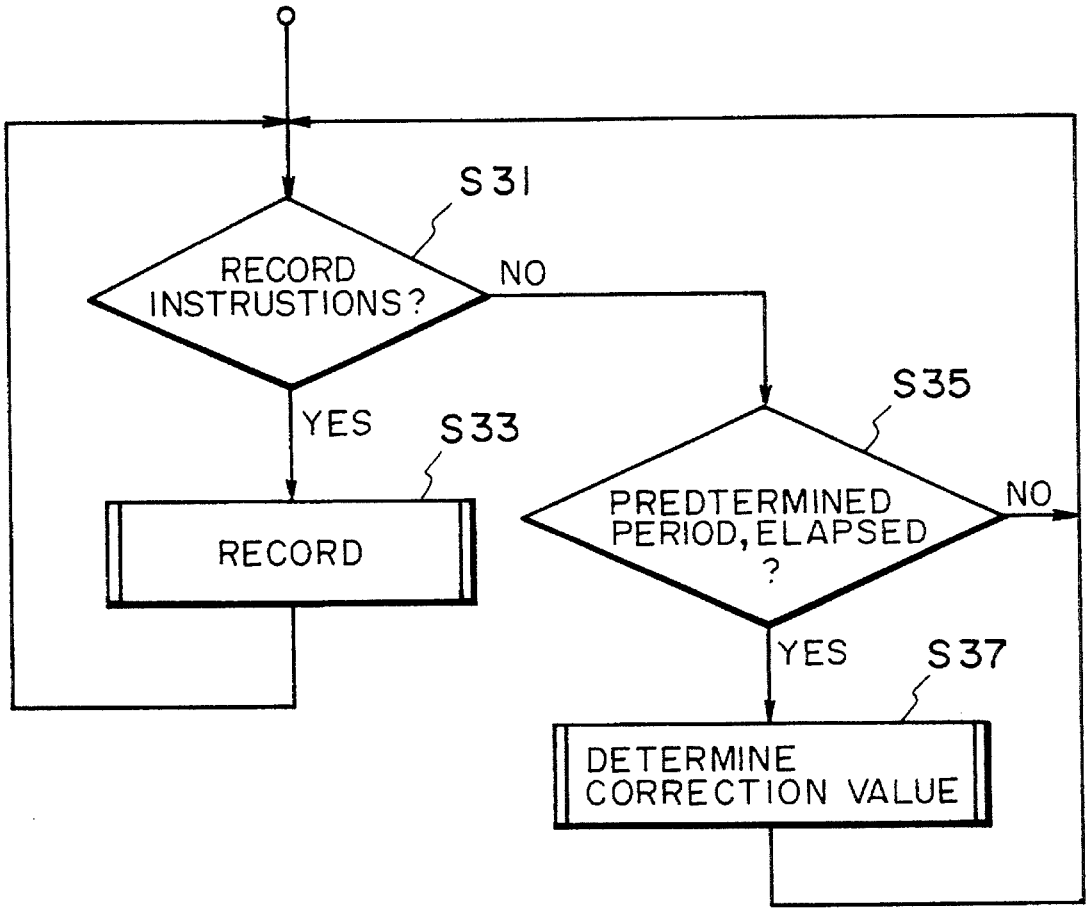
FIG. 19 is a flow chart of an example of process steps for determining the sensor correction.

FIG. 19 shows the process steps of such a type. At step S31, the discrimination is made as to whether the recording instructions are produced. If so, step S33 is executed in which the ejection heaters 5 are driven in accordance with the data to be recorded to perform the recording operation. During the operation, the temperature control shown in FIG. 17 can be executed.

If, on the other hand, the result of discrimination at the step S31 is negative, a step S35 is executed in which the discrimination is made as to whether a predetermined period (the time period required for the temperature of the recording head to reach the ambient temperature, for example) passes without the recording operation (step S33). If not, the step S31 is executed. If so, a step S37 is carried out, by which the correction value determining process similar to the steps S13–S17 is performed, and the sequential operation returns to the step S31.

According to this process, even when the property of the temperature sensor changes for some reason or another, the control system can meet it. In addition, there is no problem even if a head cartridge once mounted in the main assembly is re-mounted into the same main assembly after the main assembly is operated with another cartridge.

According to this process, the resistor 9 may be omitted, and the correction value in the RAM is not needed to be backed up, and therefore, the cost of the recording head or the main assembly is not increased.

It is a possible alternative that the correction value determining process is performed at the start of the recording operation.

In the foregoing, the description has been made with respect to a liquid jet recording apparatus using a head cartridge containing as a unit the recording head and the ink container. However, they may be separate, and the ink container is not necessarily disposable.

The temperature sensor 2 may be in the form of a thermistor, a diode, a transistor or the like. The temperature sensor 2 may be simultaneously formed with the ejection heater 5 on the heater board 1, but it may be separately formed. In addition, it may not be formed on the heater board. A proper number of such temperature sensors may be disposed at proper positions.

In the foregoing, the reference temperature sensor is disposed in the main assembly, but an operator may input the ambient temperature by key input or the like.

Furthermore, the apparatus is not limited to the serial type recording system if a disposable type recording head or head cartridge is used.

As described in the foregoing, even if an output of a temperature sensor in the recording head varies, it can be corrected to perform the correct temperature control.

A display may be provided to display the fact that the output correcting process for the temperature sensor in the recording head is being carried out.

Figure 20:
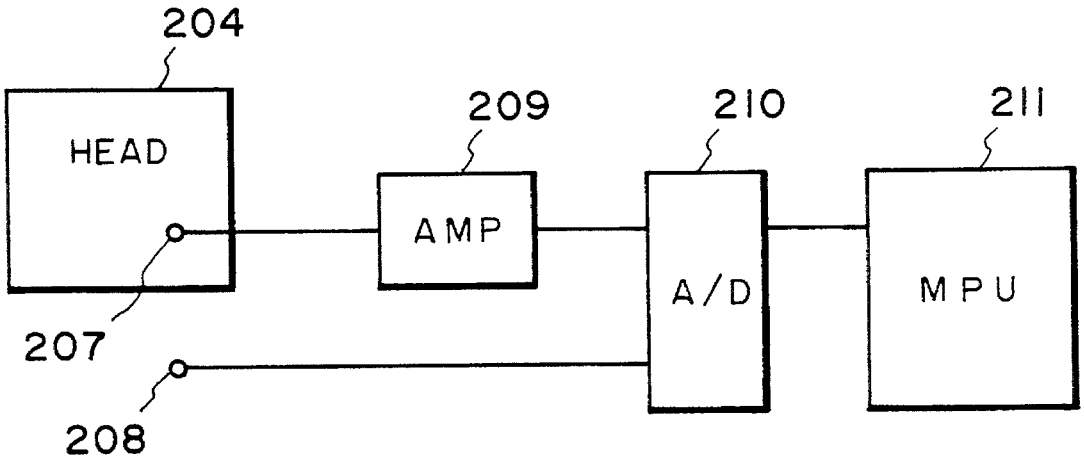
FIG. 20 is a block diagram illustrating a liquid jet recording apparatus wherein an output of the temperature sensor is corrected, according to a further embodiment of the present invention.
Figure 21:
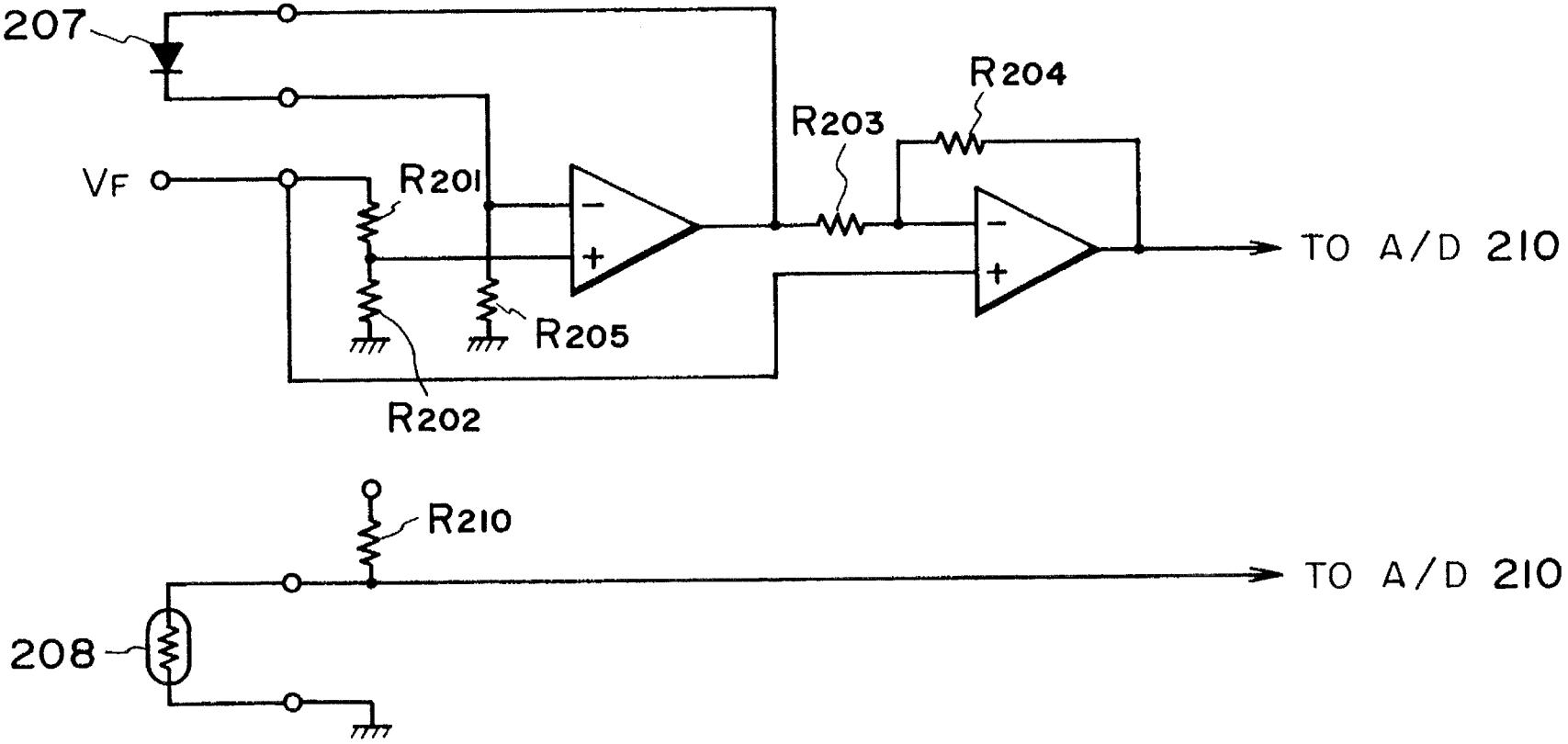
FIG. 21 shows an example of an amplifier shown in FIG. 20.

Referring to FIG. 20, an embodiment of this type will be described. A recording head 204 includes ejection outlets for ejecting recording liquid and energy generating elements disposed corresponding to the respective ejection outlets to produce energy for ejecting the recording liquid. In this embodiment, the energy generating elements is in the form of a heater. When the heater is energized, it produces heat, by which a bubble is produced in the recording liquid in the nozzle, and a droplet of the recording liquid is ejected through the ejection outlet. A first temperature detecting element 207 in the form of a semiconductor diode is formed in the recording head 204, and detects the temperature of the recording head 204 on the basis of a forward voltage drop which depends on the temperature. An amplifier 209 amplifies a signal from the semiconductor diode 207. FIG. 21 shows an example of the amplifier 209. A second temperature detecting element 208 is in the form of a thermistor and detects a temperature adjacent to the recording head 204. An A/D converter 210 converts an analog signal from the amplifier 209 and the thermistor 208 to a digital signal. First correcting means 211 in the form of a MPU corrects a first temperature detected by a semiconductor diode on the basis of a second temperature detected by the thermistor 208.

FIGS. 22A–22D shows various relations between the recording head 204 and the thermister 208.

Figure 22A:
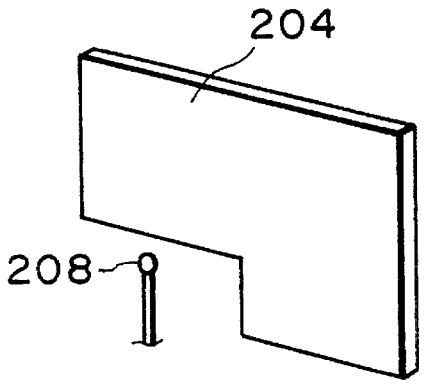

In FIG. 22A, the thermistor 208 is disposed adjacent to the recording head 204 without contact.

Figure 22C:
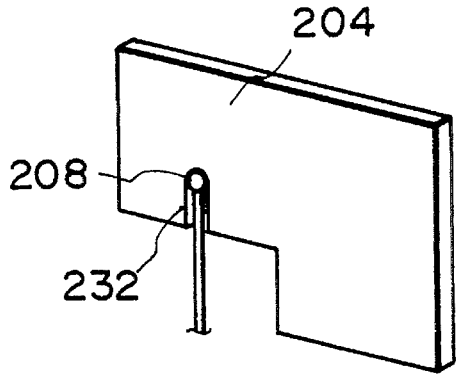
Figure 22B:
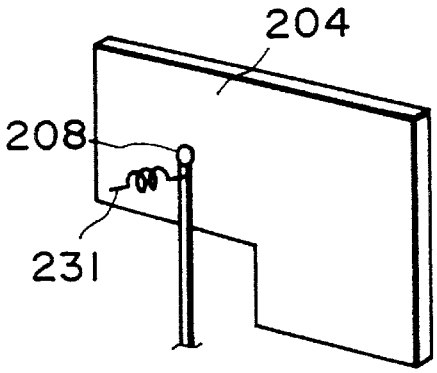

FIG. 22B shows an example wherein the thermistor 208 is contacted to the recording head 204 by a resilient force of the spring 231. In this embodiment, the thermal resistance is smaller than in the example of FIG. 22A, and the thermal response is improved.

FIG. 22C shows an example wherein the thermistor 208 is contacted to a cut-away portion 232 formed in the recording head 204. In this example, the contact is almost a line contact as compared with the point contact in FIG. 22B, and therefore, the contact area of the thermistor 208 is larger than in FIG. 22B example and the thermal response is further improved.

Figure 22D:
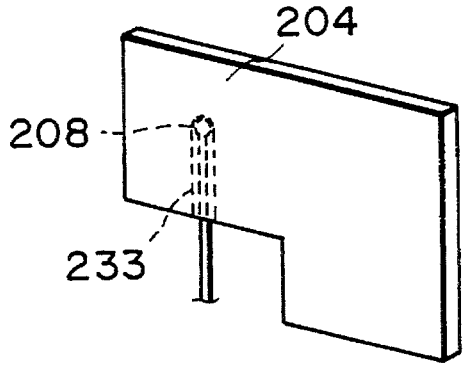

FIG. 22D shows an example wherein the thermistor 208 is inserted into a cylindrical bore 233 formed in the recording head. The contact area of the thermistor 208 is further enlarged as compared with the FIG. 22C example. Therefore, the thermal response is further improved.

Figure 23:
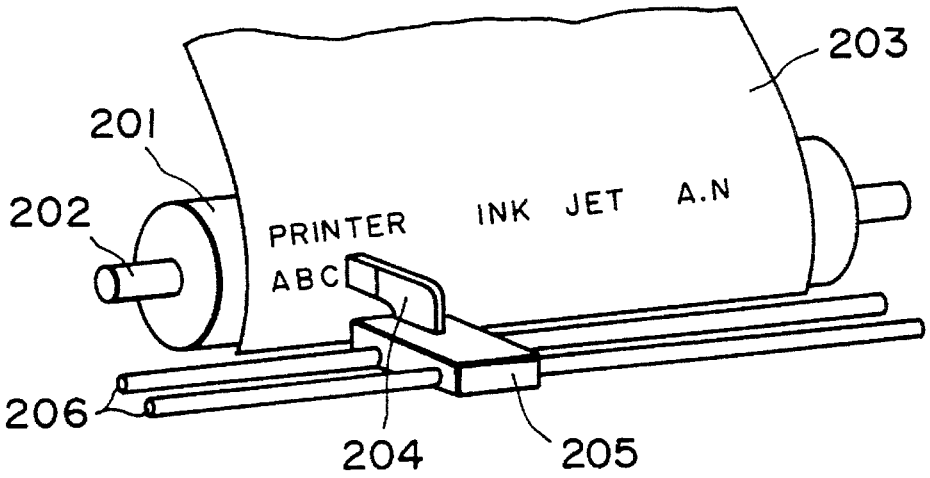
FIG. 23 shows the structure of the liquid jet recording apparatus shown in FIG. 20.

Referring to FIG. 23, there is shown an external view of the ink jet recording apparatus in this embodiment. A reference numeral 204 shows the same element as in FIG. 20. The recording apparatus includes a platen 201 mounted rotatably about a shaft 202, a carriage 205 for carrying the recording head 204 and a supporting rod 206 for guiding the carriage 206 along the shaft 202 of the platen 201. Designated by a reference 203 is a recording sheet set on the platen 201.

Figure 24:
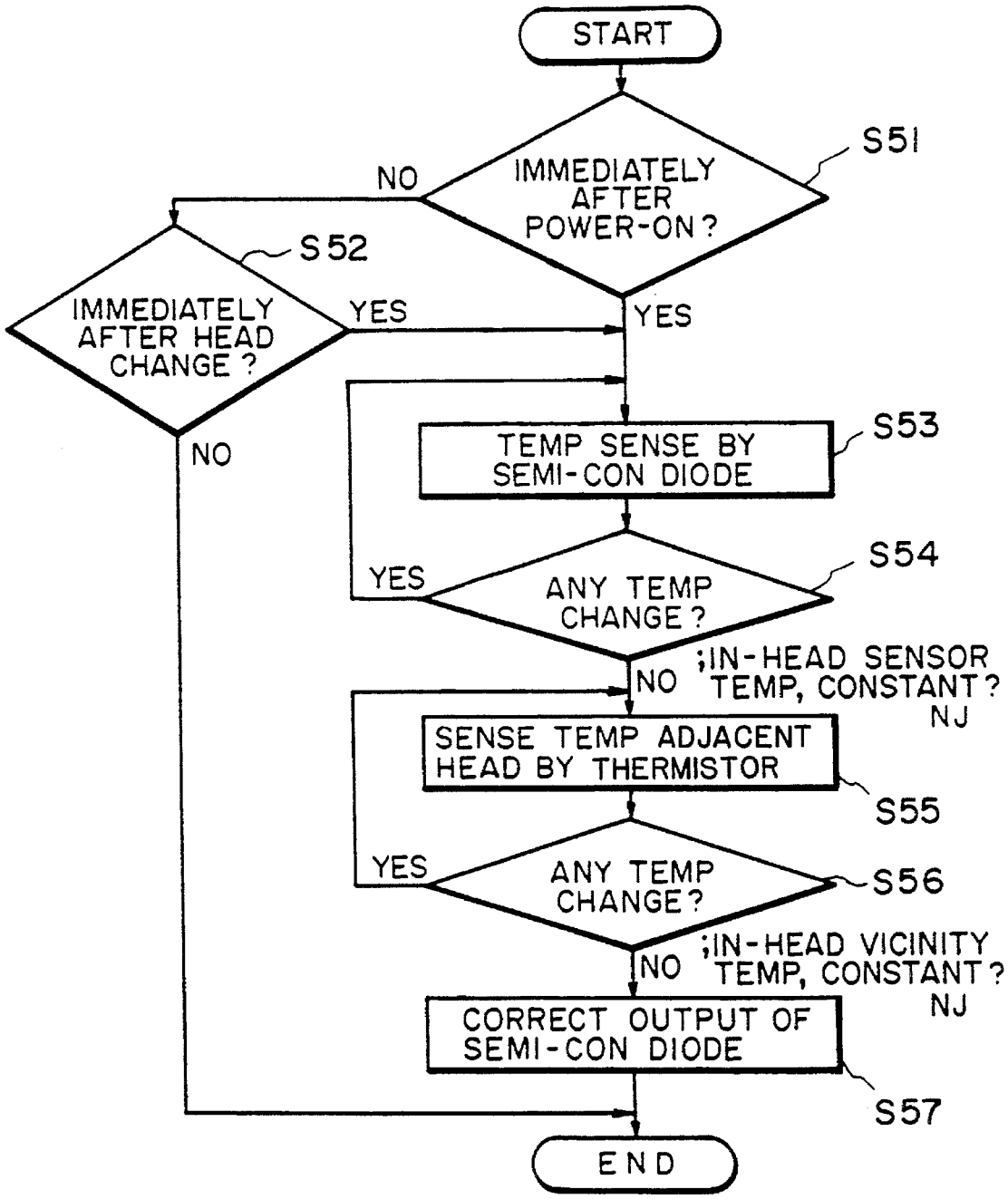
FIG. 24 is a flow chart illustrating an example of the temperature correcting process using MPU.

FIG. 24 is a flow chart of an example of the temperature correcting process using the MPU 211.

At step S51, the discrimination is made as to whether or not it is immediately after the main switch is closed. If not, step S52 is executed, in which the discrimination is made as to whether or not it is immediately after the exchange of the recording head 204. If so, a step S53 is executed in which the temperature of the recording head 204 is detected by a semiconductor diode 207 formed in the recording head 204. At step S54, the discrimination is made as to whether the detected temperature changes. If so, the operational sequence returns to the step S53, and thereafter, the process steps S53 and S54 are repeated. When the temperature change disappears as a result of discrimination at the step S54, a step S55 is executed by which the temperature adjacent to the recording head 204 is detected by the thermistor 208.

After the temperature adjacent to the recording head 204 is detected, the discrimination is made as to whether or not the detected temperature changes, at step S56. If so, the operational sequence returns to the step S55, and the steps S55 and S56 are repeated. When the temperature change is discriminated as having disappeared at step S56, a step S57 is executed in which an output of the A/D converter when the temperatures detected by the semiconductor diode 207 and the thermistor 208 are stabilized is stored, and the temperature detected by the semiconductor diode 207 is corrected on the basis of the temperature detected by the thermistor 208.

If the result of the discrimination at step S51 indicates that it is immediately after the main switch is actuated, a step S53 is executed. If the result of the discrimination at step S52 indicates that it is not immediately after the recording head is exchanged, the temperature correction process ends.

Figure 25:
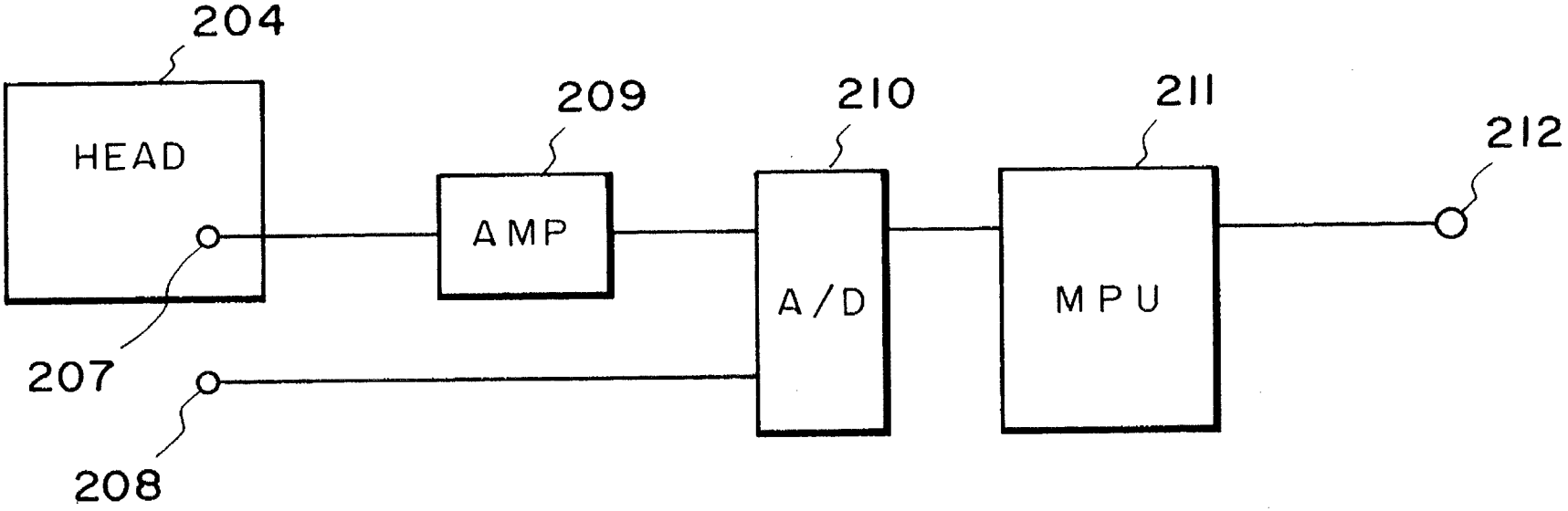
FIG. 25 is a block diagram illustrating a liquid jet recording apparatus according to a further embodiment of the present invention.

FIG. 25 is a block diagram showing an example having the same structure as shown in FIG. 20, but having the function of displaying "in process" and "end" of the temperature correction. Reference numerals 204, 207–211 designate the same elements as in FIG. 20. A first display 212 functions to display "in process" and "end" of the temperature correction process. It is constituted by LED elements, and flickers during the temperature correcting operation, and is kept on after the end of the temperature correction. The signals indicating the in-process of the temperature correcting process and the end thereof are transmitted through an interface to a host computer (not shown) for controlling the apparatus.

Figure 26:
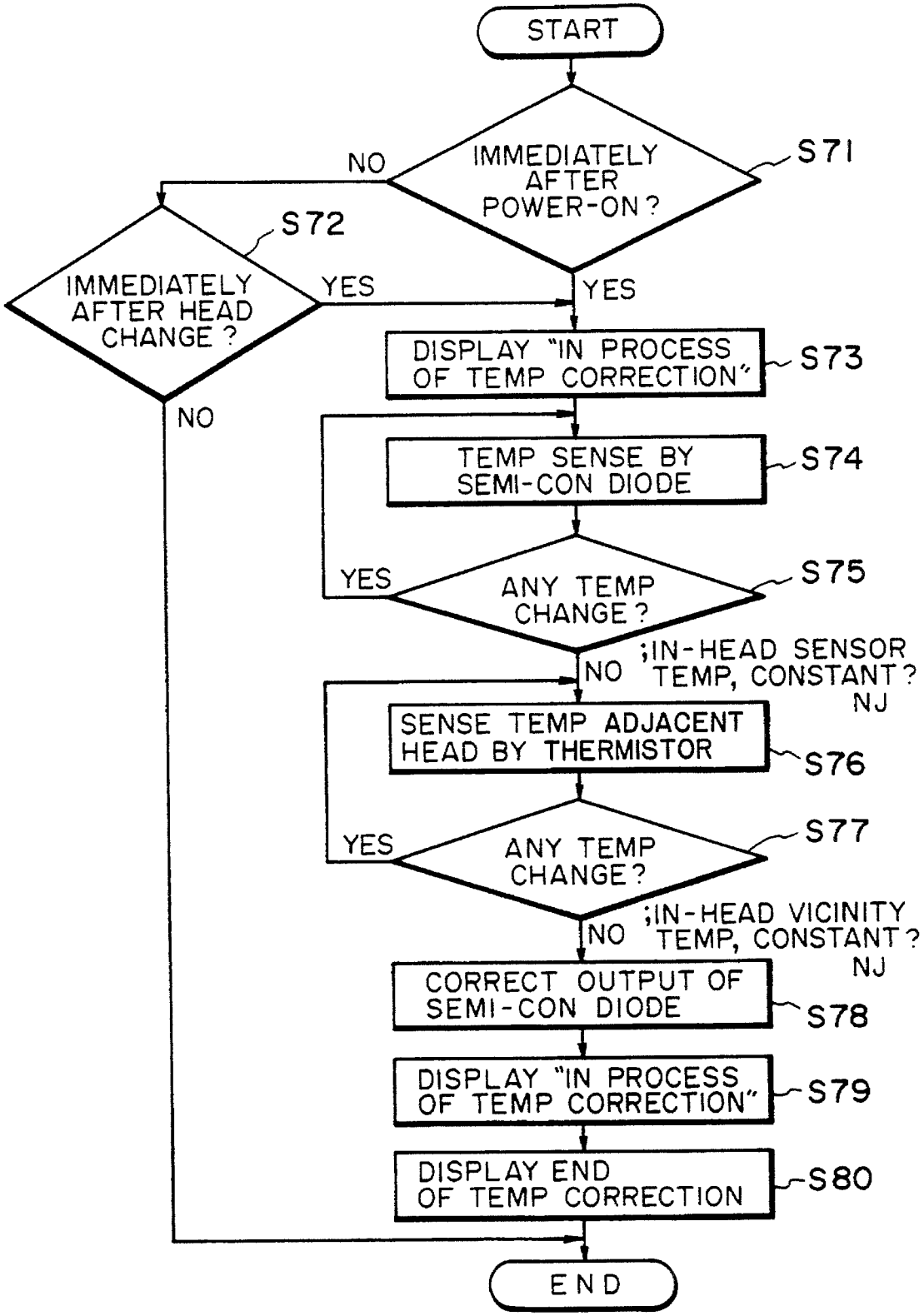
FIG. 26 is a flow chart showing an example of process steps for correcting the temperature using MPU.

FIG. 26 is a flow chart illustrating an example of the temperature correcting process using the MPU 211.

At step S71, the discrimination is made as to whether or not it is immediately after the main switch is closed. If not, a step S72 is executed in which the discrimination is further made as to whether or not it is immediately after the recording head 204 is exchanged. If so, a step S73 is carried out in which the LED element of the in-process/end display device 212 starts to flicker to notify the operator of the start of the temperature correcting operation. At step S74, the temperature of the recording head 4 is detected by a semiconductor diode 207 formed in the recording head 204. At step S75, the discrimination is made as to whether or not the detected temperature is changing. If so, the operational sequence returns to the step S74, and thereafter, the process steps S74 and S75 are repeated. If the result of discrimination at step S75 indicates that the temperature change disappears, a step S76 is executed to detect the temperature in the neighborhood of the recording head 204 by the thermistor 208.

After the temperature adjacent to the recording head 204 is detected, the discrimination is made as to whether or not the detected temperature is changing at step S77. If so, the operational sequence returns to the step S76, and the steps S76 and S77 are repeatedly performed. If the result of discrimination at step S77 indicates that the temperature change disappears, the operational sequence advances to step S78 wherein outputs of the A/D converter when the temperatures detected by the semiconductor diode 207 and the thermistor 208 are stabilized is stored. The temperature detected by the semiconductor diode 207 is corrected on the basis of the temperature detected by the thermistor 208.

After the correction, at step S79, the flickering of the LED element of the in-process/end display device 12 is stopped to notify the operator of the end of the temperature correcting operation. At step S80, the LED element of the in-process/end display device 211 is turned on to notify the operator of the end of the temperature correcting process. If the result of discrimination at step S71 indicates that it is immediately after the main switch is closed, a step S73 is executed.

If the result of the discrimination at step S72 indicates that it is immediately after the recording head is exchanged, the temperature control process ends.

According to this embodiment, the operator is able to know the operational stage of the apparatus.

In the foregoing embodiment, the in-process and the end of the temperature correcting process are displayed. As an alternative, the display can show whether or not the temperature correcting process has been successfully completed.

Figure 27:
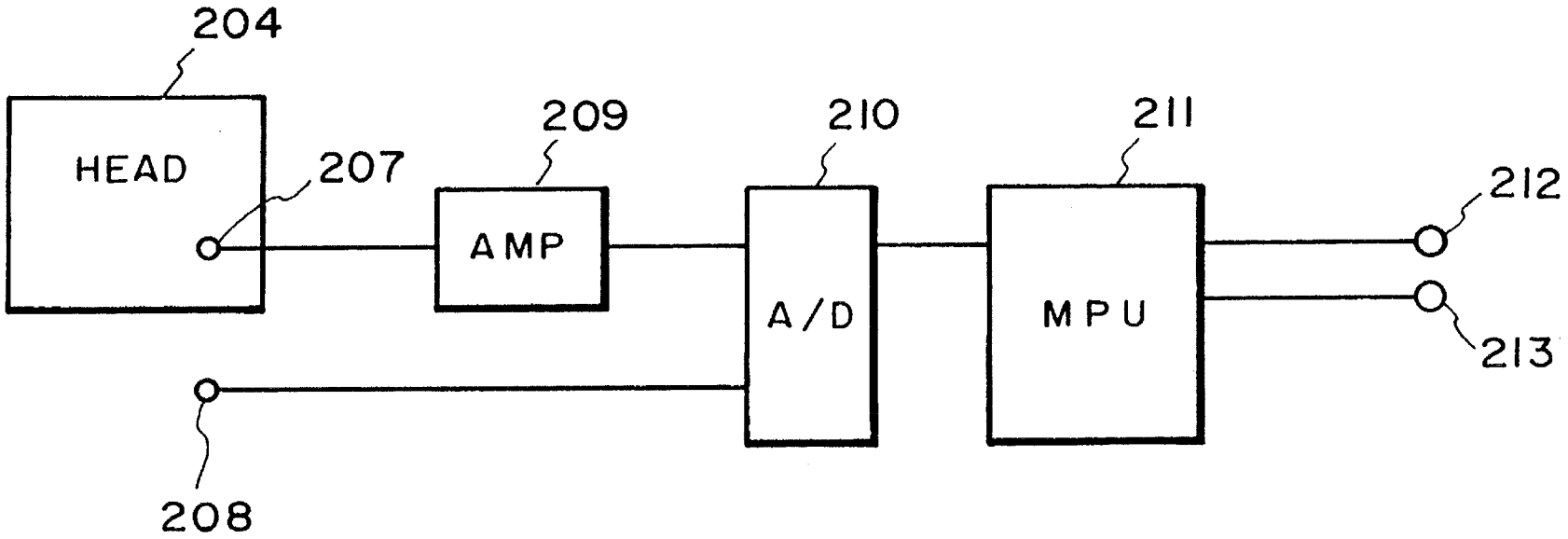
FIG. 27 is a block diagram illustrating a liquid jet recording apparatus according to a further embodiment of the present invention.

FIG. 27 is a block diagram illustrating an embodiment of this type. In this Figure, reference numerals 204, 207–212 indicate the same elements as in FIG. 25. The apparatus comprises a second display 213 for displaying the success/failure of the temperature correcting process, and it is constituted by an LED element. When the temperature correcting process is successful, the LED element is turned on, and if it fails it flickers while the temperature correction value of the semiconductor diode 207 is displayed.

The success and failure signals are transmitted through an interface to a host computer (not shown) for controlling the apparatus.

Figures 28, 28A:
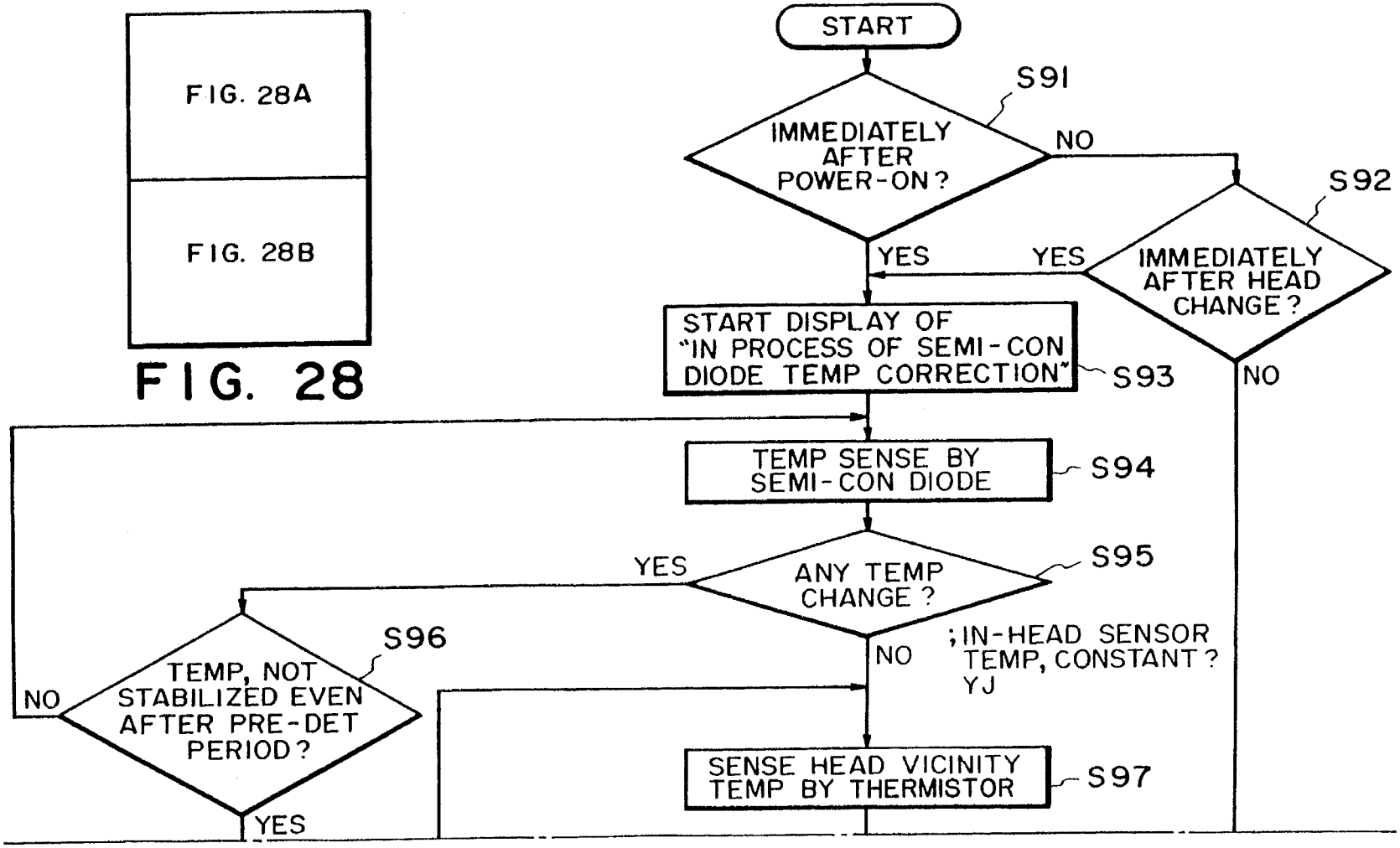
FIGS. 28, 28A, 28B are a flow chart showing an example of a temperature correcting process using MPU.
Figure 28B:
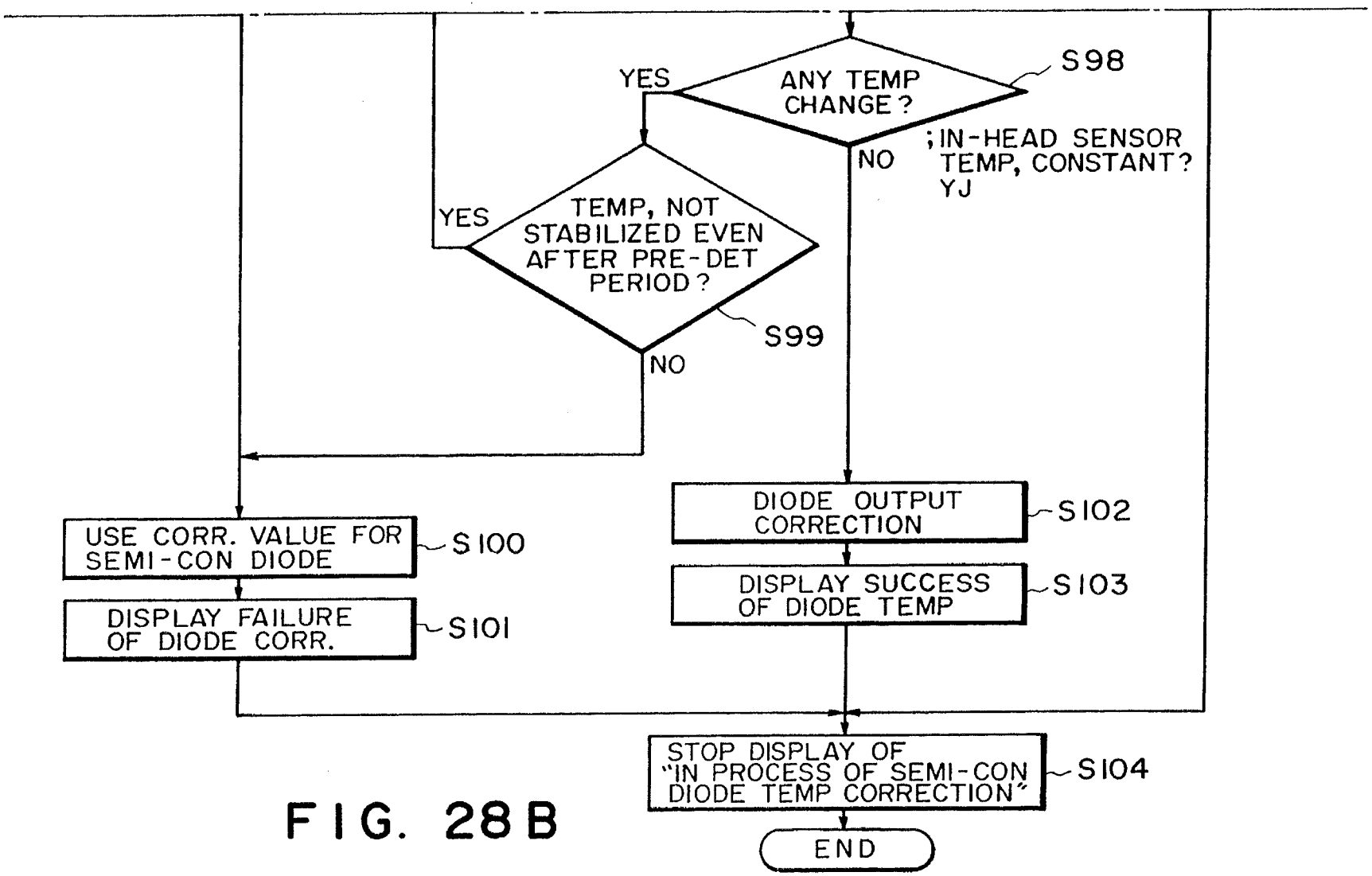

FIG. 28 is a flow chart showing an example of the temperature correcting process using the MPU 211. At step S91, the discrimination is made as to whether or not it is immediately after the main switch is closed. If not, a step S92 is executed in which the discrimination is made as to whether or not it is immediately after the exchange of the recording head 204. If so, a step S93 is executed by which the LED of the in-process/end display device 211 starts to flicker to notify the operator of the start of the temperature correcting operation. At step S94, the temperature of the recording head is detected by the semiconductor diode 207 formed in the recording head 204. At step S95, the discrimination is made as to whether or not the detected temperature is changing. If so, a step S96 is carried out in which the discrimination is made as to whether or not the temperature is stabilized after a predetermined period elapses. If so, the operational sequence returns to step S94, and thereafter, the steps S94, S95 and S96 are repeatedly executed. If the result of discrimination at step S96 indicates that the temperature is not stabilized, a step S100 is executed in which the temperature detected by the semiconductor diode 207 is corrected, and at step S101, the LED element of the success/failure display device 213 flickers to notify the operator of the failure of the temperature correcting process for the semiconductor diode 207. At step S104, the flickering of the LED element of the in-process/end display device 212 is stopped to signal the end of the temperature correcting process.

If, on the other hand, the result of discrimination at step S95 indicates that this temperature change disappears, step S97 is executed by which the temperature adjacent to the recording head is detected by the thermistor 208.

After the temperature is detected adjacent to the recording head, the discrimination is made as to whether or not the detected temperature is changing at step S98. If so, a step S99 is executed wherein the discrimination is made as to whether or not the temperature is stabilized after a predetermined period elapses. If not, the operational sequence returns to the step S97, and thereafter, the steps S97 and S98 and S99 are repeatedly executed. If the result of discrimination at step S99 indicates that the temperature is not stabilized, the operational sequence advances to step S100. A proper correction value is imparted to the semiconductor diode, and it is displayed that the correcting process for the semiconductor diode failed at step S101.

If the result of discrimination at step S98 indicates that there is no temperature change, a step S102 is executed in which outputs of the A/D converter when the temperatures detected by the semiconductor diode 207 and the thermistor 208 are stored, and the temperature detected by the semiconductor diode 207 is corrected on the basis of the temperature detected by the thermistor 208.

After the correction, the LED of the success/failure display device 213 is turned on at step S103 to notify the operator of the success of the temperature correcting process.

If the result of discrimination at step S91 indicates that it is immediately after the main switch is closed, the step S93 is executed.

If the result of discrimination at step S92 indicates that it is immediately after the recording head is exchanged, a step S104 is executed.

According to this embodiment, the operator is able to know the operational stage of the apparatus.

Figure 29:
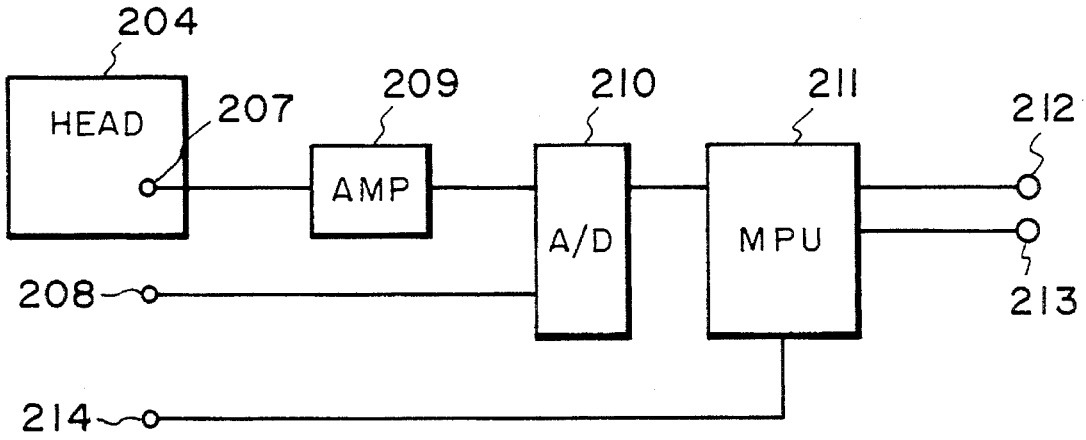
FIG. 29 is a block diagram illustrating a liquid jet recording apparatus according to a further embodiment of the present invention.

FIG. 29 illustrates another embodiment wherein the output correcting process for the semiconductor diode is performed at a predetermined temperature. Reference numerals 204, 207–213 indicate the same elements as in FIG. 27. The apparatus comprises a heater 214 (first and second temperature control means) functioning to heat the neighborhood of the recording head 204.

FIGS. 30A–30D show various positional relations between the recording head 204 and the thermistor 208.

Figure 30A:
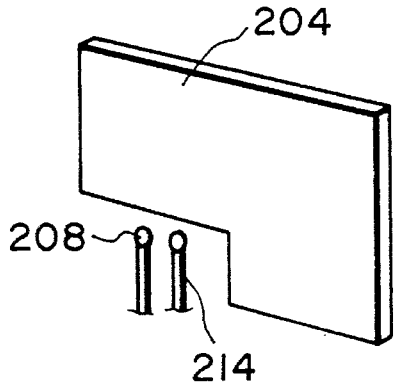

In FIG. 30A, the thermistor 208 and the recording head 204 are in the positional relation shown in FIG. 22A, and the heater 214 is disposed adjacent to the recording head 204 without contact.

Figure 30C:
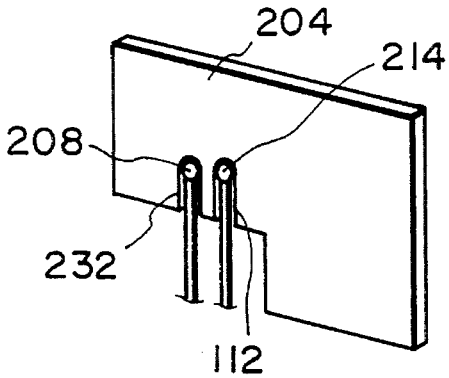
Figure 30B:
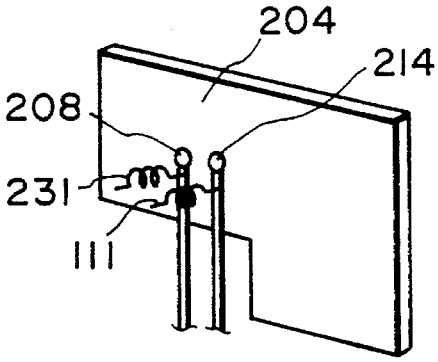

FIG. 30B shows an example wherein the thermistor 208 and the recording head 204 are disposed in the positional relation shown in FIG. 22B, and the heater 214 is contacted by spring force of spring 111. In this example, the thermal resistance is smaller than in the example of FIG. 30A, and therefore, the thermal response is improved.

FIG. 30C shows an example wherein the thermistor 208 and the recording head 204 are disposed in the positional relation shown in FIG. 22C, and wherein the heater 214 is contacted to a cut-away portion 112 formed in the recording head. The contact in this example is closer to a line contact than in the example of FIG. 30B (point contact), and therefore, the contact area of the heater 214 is larger than in FIG. 30B example. This further improves the thermal response.

Figure 30D:
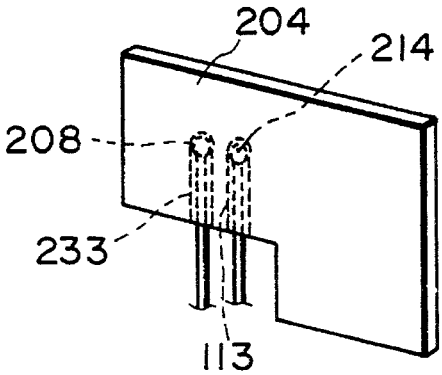

FIG. 30D shows an example wherein the thermistor 208 and the recording head 204 are disposed in the positional relation shown in FIG. 22D, and the heater 214 is inserted into a cylindrical bore 113 formed in the recording head 204. In this example, the contact area of the heater is further expanded as compared with FIG. 30C example. Therefore, the thermal response is further improved.

Figures 31, 31A, 31B:
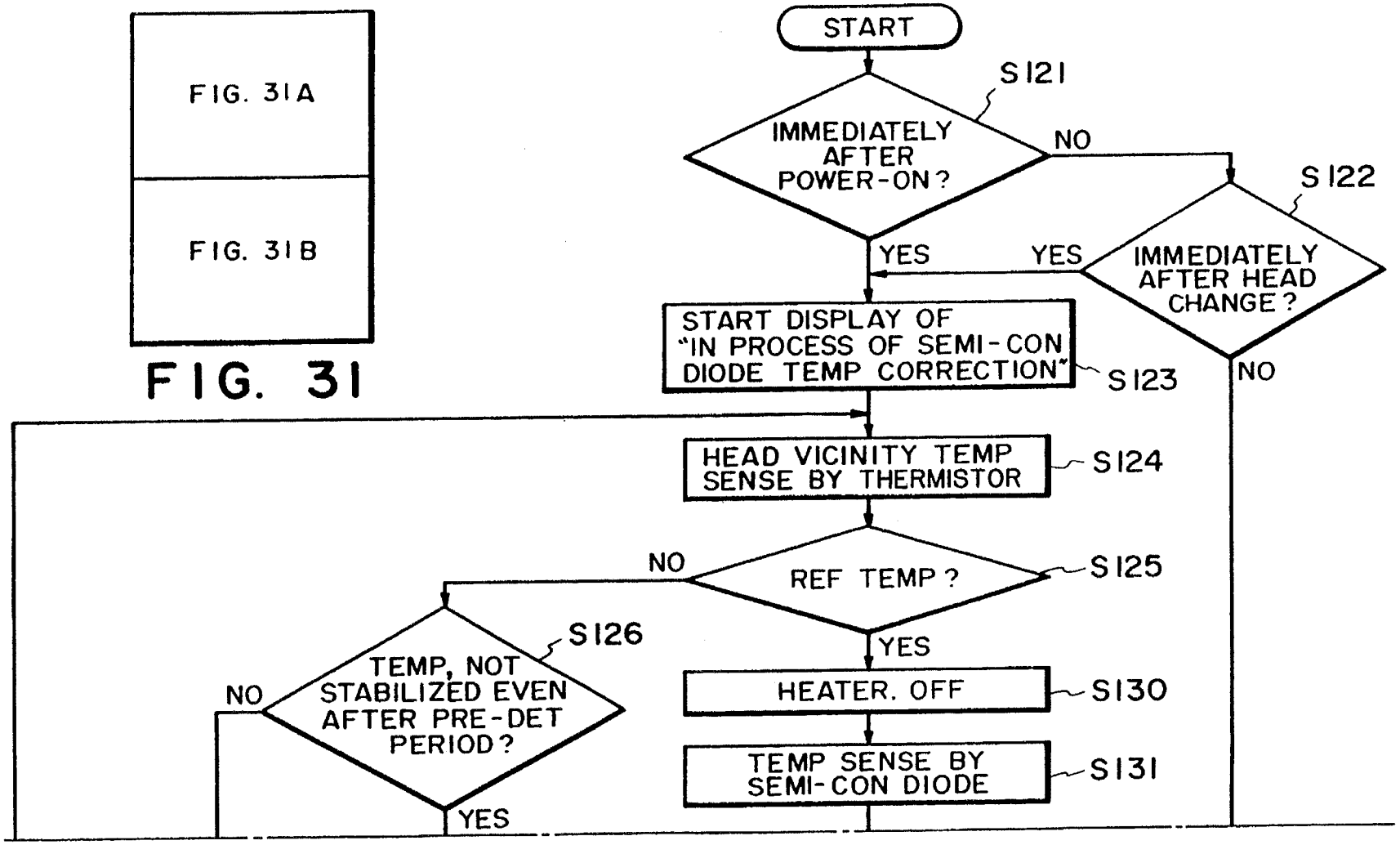
FIGS. 31, 31A, 31B are a flow chart of an example of a temperature correcting process using MPU.
Figure 31B:
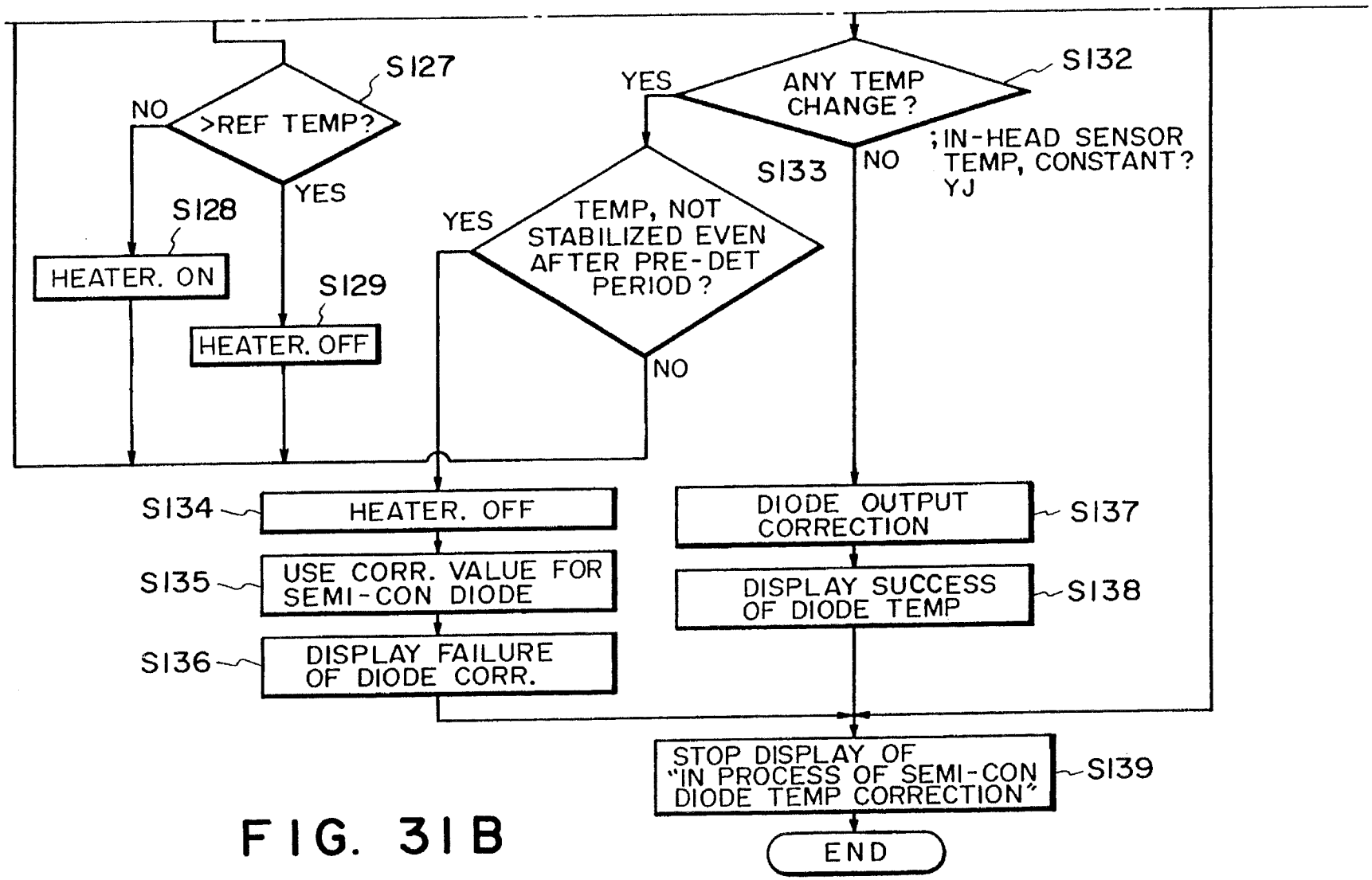

FIG. 31 is a flow chart illustrating an example of a temperature correcting process using the MPU 211. At step S121, the discrimination is made as to whether or not it is immediately after the main switch is closed. If not, a step S122 is executed in which the discrimination is made as to whether or not it is immediately after the recording head is exchanged. If so, a step S123 is executed in which the flickering of the LED element of the in-process/end display device 212 is started to notify the operator of the start of the temperature correcting process.

At step S124, the temperature of the recording head 204 is detected by a semiconductor diode 207 formed in the recording head 204. At step S125, the discrimination is made as to whether or not the detected temperature is a predetermined temperature. If not, a step S126 is carried out in which the discrimination is made as to whether or not the temperature is stabilized after a predetermined period elapses. If not, a step S127 is executed in which the discrimination is made as to whether or not it is higher than the predetermined temperature. If not, the heater is energized at step S128, and the operational sequence returns to step S124, and thereafter, steps S124, S125, S126, S127 and S128 are repeatedly executed.

If the result of the discrimination at step S125, that is, the discrimination relative to the predetermined temperature, indicates that it is the predetermined temperature, step S130 is executed to turn off the heater 214. After the heater 214 is deenergized, the temperature of the recording head 204 is detected by the semiconductor diode 207 at step S131. At step S132, the discrimination is made as to whether or not the detected temperature is changing. If so, a step S133 is executed in which the discrimination is made as to whether or not the temperature is stabilized after a predetermined period of time elapses. If so, the operational sequence returns to the step S124.

At step S126, the discrimination is made as to whether or not the temperature is stabilized after a predetermined period elapses. If not, a step S134 is executed by which the heater 214 is deenergized.

After the heater 214 is deenergized at step S134, the temperature detected by the semiconductor diode 207 is corrected at step S135. At step S136, the temperature correcting value for the semiconductor diode 207 is displayed by the LED element of the success/failure display device 213, and the display flickers to notify the operator of the failure of the correcting process. At step S139, the LED element of the in-process/end display device 212 flickers to notify the operator of the end of the temperature correcting process.

During the repeated execution of the steps S124, S125, S126, S127 and S128, the discrimination at S127 indicates that the temperature is higher than the predetermined temperature, step S129 is executed by which the heater is deenergized, and the operational sequence returns to the step S124.

If, during the execution of the steps S124, S125, S130, S131, S132 and S133, the results of discrimination at step S132 indicates that the temperature is not stabilized, a step S137 is executed in which the temperature detected by the semiconductor diode 207 is corrected. At step S138, the LED element of the success and failure display device 213 is turned on to notify the operator of the success of the temperature correction of the semiconductor diode 207. At step S139, the flickering of the LED element of the in-process and end display device 212 is stopped to notify the operator of the end of the temperature correcting process.

If, during repeated execution of the steps S124, S125, S130, S131, S132 and S133, the discrimination at step S133 indicates that the temperature is not stabilized even after a predetermined period, a step S134 is executed.

If the discrimination at the step S121 indicates that it is immediately after the main switch is closed, the step S123 is executed.

If the result of discrimination at step S122 indicates that it is not immediately after the recording head is exchanged, the step S139 is carried out.

In the foregoing embodiment, a heater 214 is used to heat the neighborhood of the recording head 204, but it is a possible alternative to cool the neighborhood of the recording head using a cooling means.

Figure 32:
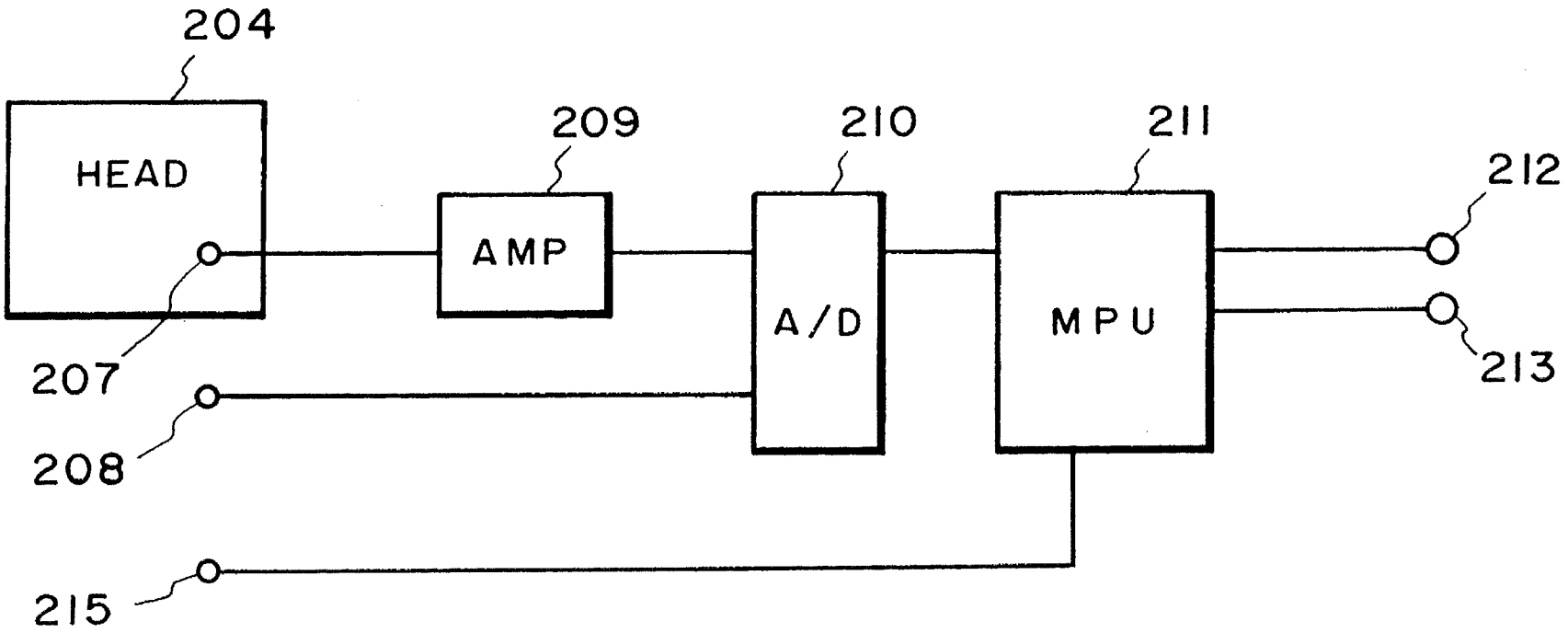
FIG. 32 is block diagram illustrating a liquid jet recording apparatus according to a further embodiment of the present invention.

FIG. 32 shows an example of this type. The apparatus of this embodiment comprises cooling means 215 disposed in the same positional relation relative to the recording head 204 and the thermistor 208 as in the heater 214 shown in FIG. 30.

Figures 33, 33A:
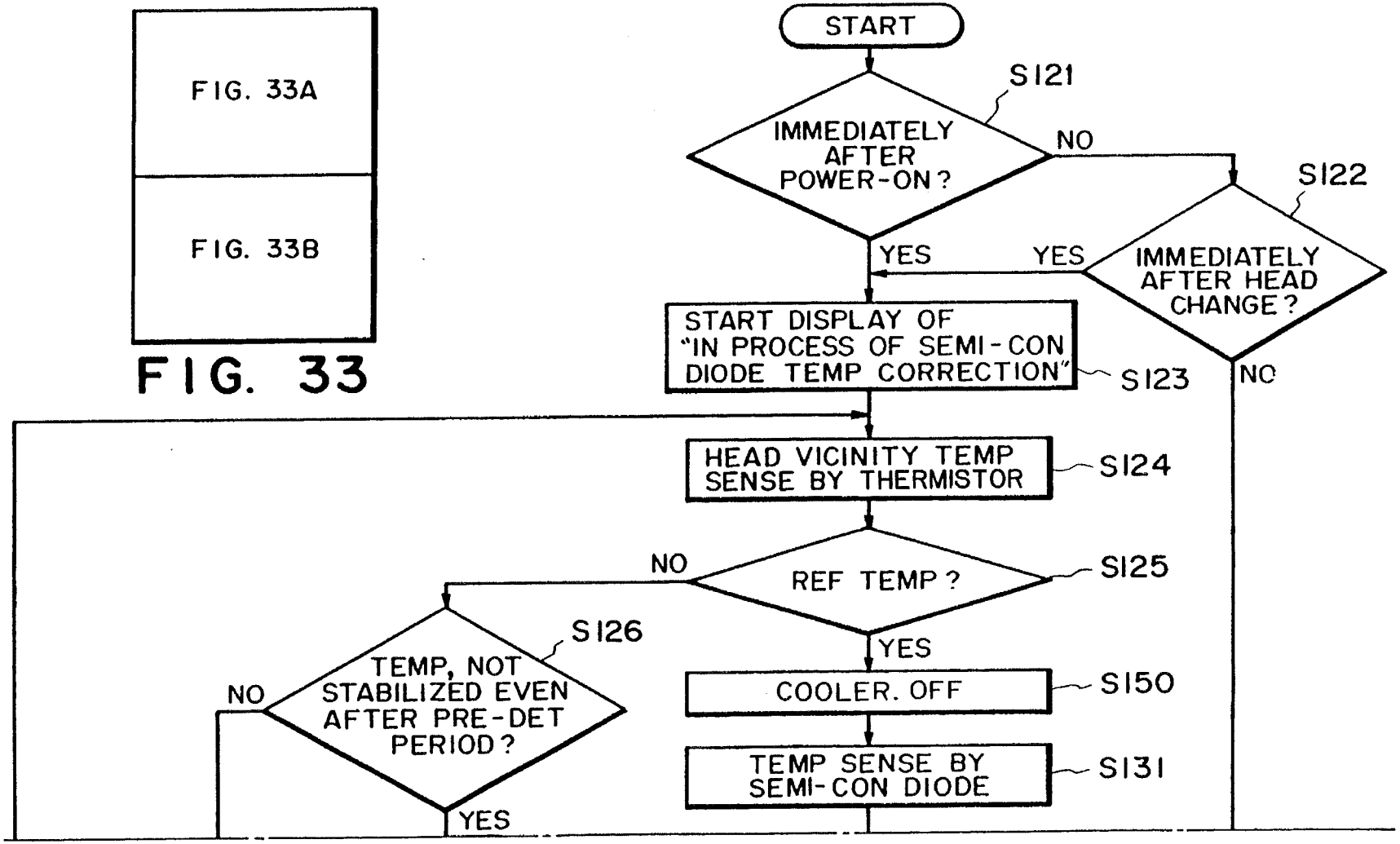
FIGS. 33, 33A and 33B are a flow chart showing an example of a temperature correcting process using MPU.
Figure 33B:
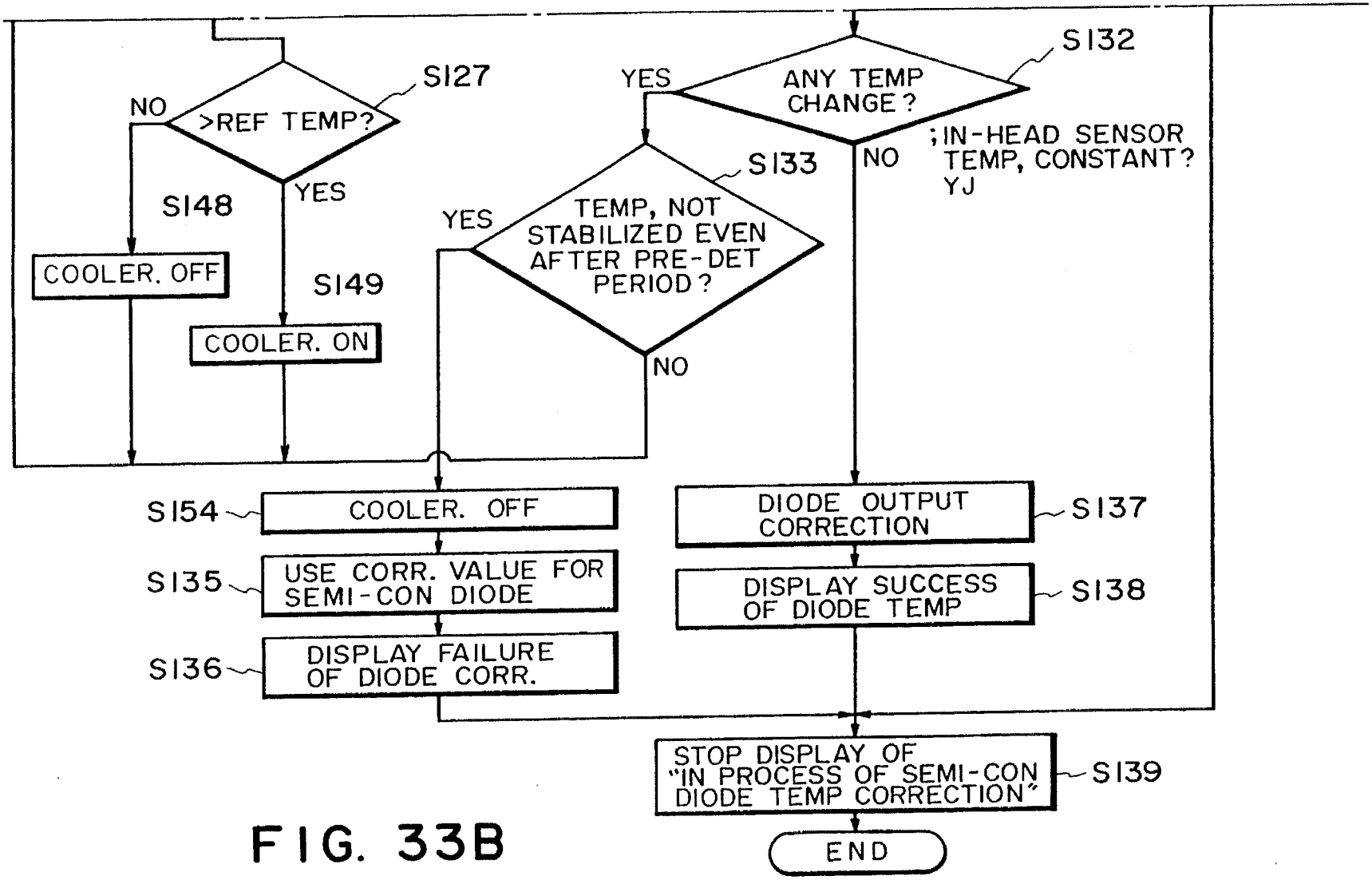

FIG. 33 is a flow chart illustrating an example of the temperature correcting process using the MPU 211. As compared with the foregoing embodiment, the temperature correcting process of this embodiment is different in the step which is executed when the result of discrimination at the step S125 indicates that it is the predetermined temperature, the step which is carried out when the result of the discrimination at the step S126 indicates that the temperature is not stabilized even after the predetermined period has elapsed, the step which is executed when the result of discrimination at step S127 indicates that the temperature detected is not higher than the predetermined temperature and the step which is executed when the result of discrimination at step S127 indicates that the detected temperature is higher than the predetermined temperature.

More particularly, if the result of discrimination at the step S125 indicates that it is the predetermined temperature, a step S150 is performed, in which the cooling means 215 is deenergized, and the operational sequence returns to the step S131.

If the result of discrimination at the step S126 indicates that the temperature is not stabilized even after the predetermined period elapses, a step S154 is carried out to deenergize the cooling device 215, and the operational sequence returns to S135.

If the result of discrimination at step S127 indicates that the temperature is not higher than the predetermined temperature, a step S148 is performed by which the cooling means 215 is deenergized, and the operational sequence returns to the S124.

If the result of discrimination at step S127 indicates that the temperature is higher than the predetermined temperature, a step S149 is executed by which the cooler 215 is deenergized, and the operational sequence returns to the S124.

In the foregoing embodiments, the recording head is either heated or cooled. It is possible that the apparatus is provided with a heater and a cooler.

Figure 34:
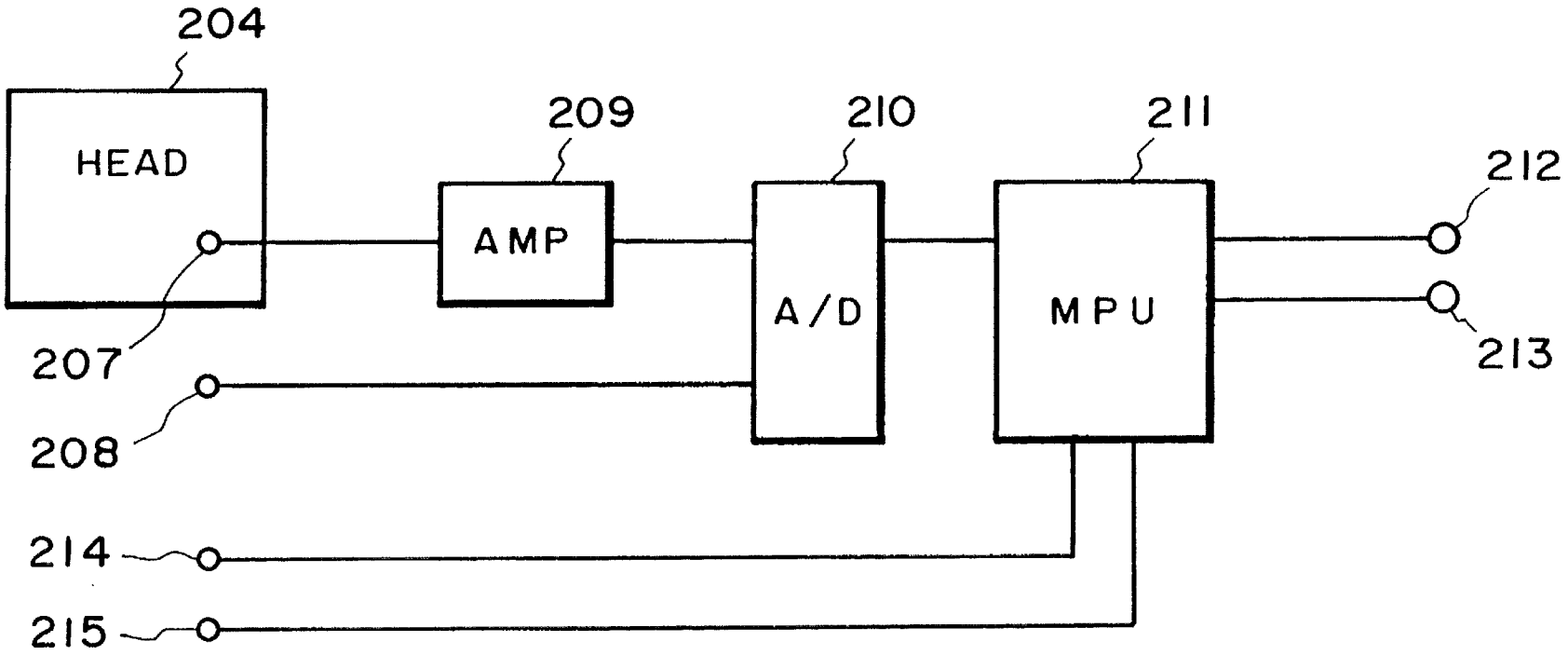
FIG. 34 is a block diagram of a liquid jet recording apparatus according to a further embodiment of the present invention.

FIG. 34 illustrates an embodiment of such a type.

The positional relation of the heater 214 and the cooler 215 relative to the recording head 204 and the thermistor 208 is the same as the positional relation shown in FIGS. 30A–30D.

Figures 35, 35A:
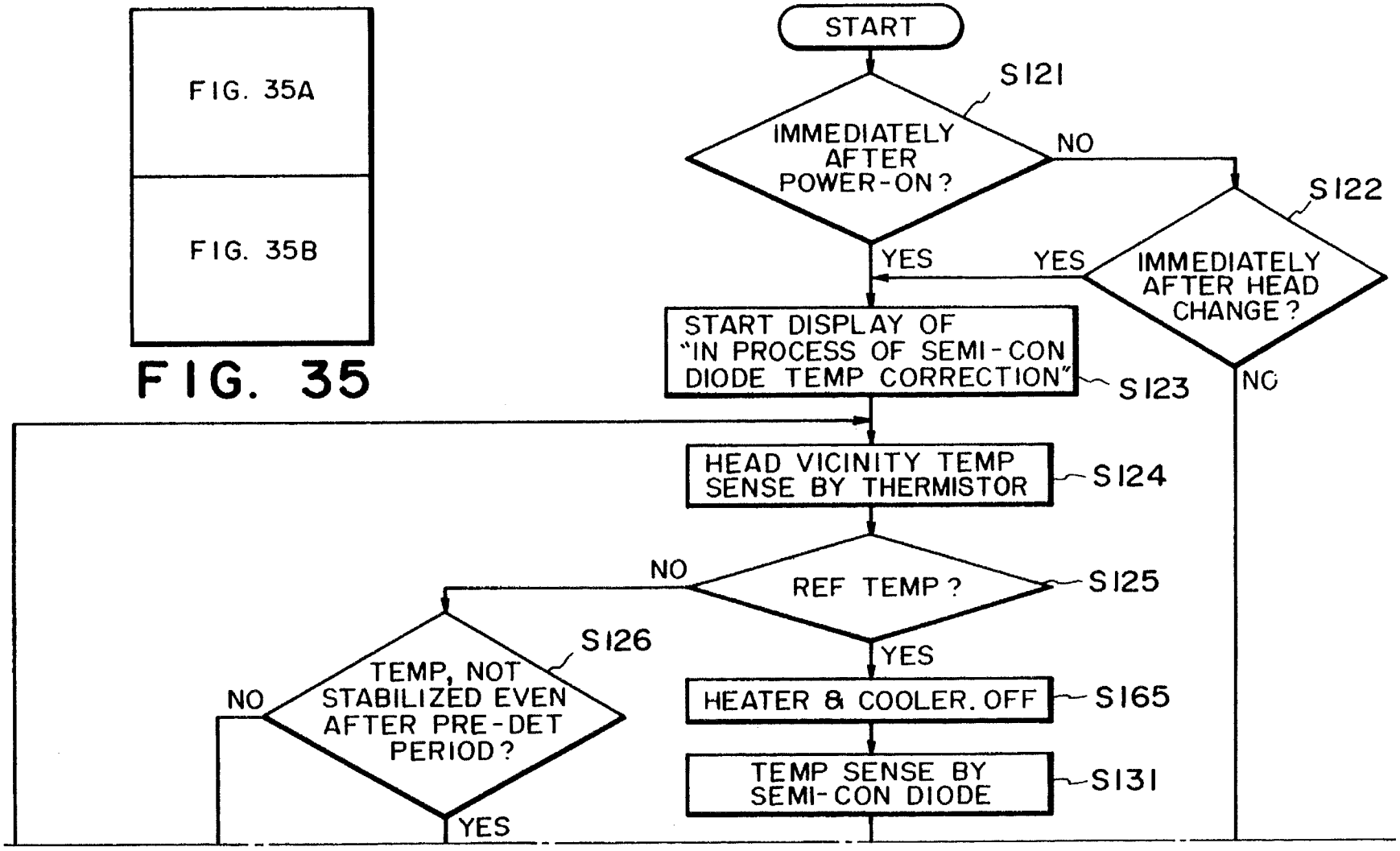
FIGS. 35, 35A and 35B are a flow chart showing an example of a temperature correcting process using MPU in FIG. 32.
Figure 35B:
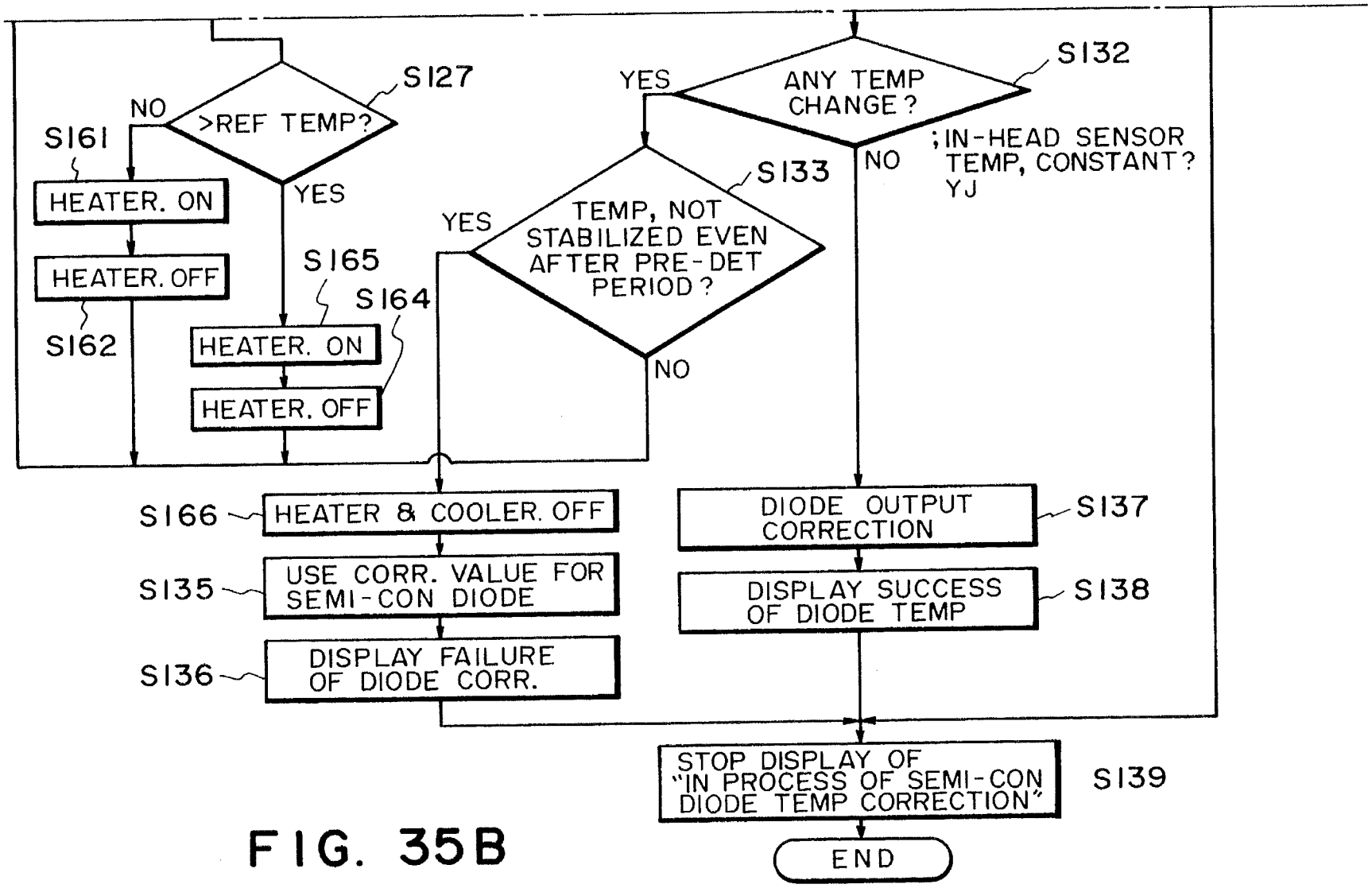

FIG. 35 is a flow chart showing an example of a temperature correcting process using the MPU 211.

As compared with the foregoing embodiment, the temperature correcting process of this embodiment is different in the step which is executed when the discrimination at the step S125 indicates that the temperature is the predetermined temperature, the step which is executed when the result of discrimination at step S126 indicates that the temperature is not stabilized even after a predetermined period elapses, the step which is executed when the result of discrimination at step S127 indicates that the temperature is not higher than the predetermined temperature, and the step which is executed when the discrimination at step S127 indicates that the detection is higher than the predetermined temperature.

When the result of discrimination at step S25 indicates that the detected temperature is the predetermined temperature, a step S165 is performed by which the heater 214 and the cooler 15 are turned off at step S165. Then, a step S131 is executed.

If the result of the discrimination at step S126 indicates that the temperature is not stabilized even after the predetermined time elapses, a step S166 is carried out by which the heater 214 and the cooling means 215 is deenergized, and the step S135 is executed.

If the result of the discrimination at step S127 indicates that the temperature is not higher than the predetermined temperature, a step S161 is performed by which the heater 214 is energized, and at step S162, the cooling device 215 is deenergized, and the operational sequence returns to the step S124.

If the discrimination at the step S127 indicates that the temperature is higher than the predetermined temperature, a step S163 is executed by which the cooling means 215 is energized, and at step S164, the heater 215 is deenergized, and the operational sequence returns to the step S124.

According to this embodiment, the maintenance cost can be reduced.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus, comprising:

a recording head detachably mountable to said apparatus and including an ejection outlet for ejecting ink, an energy generating element disposed proximate to the ejection outlet to generate energy for ejecting the ink, a temperature detecting element for detecting a temperature of said recording head and storing means for storing information to be used for discriminating a type of characteristic curve providing a predetermined output for a predetermined temperature for said temperature detecting element;

mounting means for mounting said recording head;

correcting means for correcting an output of said temperature detecting means on the basis of information stored by said storing means and outputting a corrected signal; and outputting means for outputting a control signal for controlling the temperature of the recording head in accordance with the corrected signal.

2. An apparatus according to claim 1, wherein the control signal from said outputting means is effective to maintain the temperature of said recording head at a proper level.

3. An apparatus according to claim 2, wherein said recording head further comprises a heat generating member for maintaining the desired temperature, and wherein power supplied to said heat generating member is controlled in accordance with the control signal.

4. An apparatus according to any of claims 1, 2, or 3, wherein said energy generating element generates thermal energy in response to electric power supplied thereto, and wherein a state change of the ink is caused by the thermal energy to eject a droplet of ink from the ejection outlet.

5. An ink jet recording apparatus, comprising:

a recording head detachably mountable to said apparatus and including an ejection outlet for ejecting ink, an energy generating element disposed proximate to the ejection outlet to generate energy for ejecting the ink, a temperature detecting element for detecting a temperature of said recording head and information carrying means for carrying information relating to a characteristic curve providing a predetermined output for a predetermined temperature for said temperature detecting element;

mounting means for mounting said recording head;

correcting means for correcting an output of said temperature detecting means on the basis of information carried by said information carrying means and outputting a correcting signal; and outputting means for outputting a control signal for controlling the temperature of the recording head in accordance with the corrected signal, wherein said information carrying means includes a wiring pattern which is cut differently in accordance with the characteristic curve of said temperature detecting element.

6. An apparatus according to claim 5 wherein said energy generating element generates thermal energy in response to electric power supplied thereto, and wherein a state change of the ink is caused by the thermal energy to eject a droplet of ink from the ejection outlet.

7. A recording head detachably mountable to an ink jet recording apparatus, comprising:

ejection means defining an ejection outlet for ejecting ink therethrough;

an energy generating element disposed proximate to the ejection outlet to produce energy for ejecting the ink;

a temperature detecting element for detecting a temperature;

storing means for storing information to be used for discriminating a type of characteristic curve providing a predetermined output for a predetermined temperature for said temperature detecting element; and transmitting means for transmitting the information to the ink jet recording apparatus when said recording head is mounted to the apparatus.

8. An apparatus according to claim 7, wherein said energy generating element generates thermal energy in response to electric power supplied thereto, and wherein a state change of the ink is caused by the thermal energy to eject a droplet of ink from the ejection outlet.

9. An ink jet recording apparatus for recording an image on a recording material, comprising:

mounting means for mounting a recording head including an ejection outlet for ejecting ink, an energy generating element disposed proximate to the ejection outlet to generate energy for ejecting the ink, a temperature detecting element for detecting a temperature and storing means for storing information to be used for discriminating a type of characteristic curve providing a predetermined output for a predetermined temperature for said temperature detecting element;

correcting means for correcting an output of said temperature detecting means on the basis of information stored by said storing means and outputting a corrected signal; and outputting means for outputting a control signal for controlling the temperature of the recording head in accordance with the corrected signal.

10. An apparatus according to claim 8, wherein the control signal from said outputting means is effective to maintain the temperature of said recording head at a proper level.

11. An apparatus according to claim 10, wherein said recording head further comprises a heat generating member for maintaining the desired temperature, and wherein power supplied to said heat generating member is controlled in accordance with the control signal.

12. An apparatus according to any of claims 9, 10 or 11, wherein said energy generating element generates thermal energy in response to electric power supplied thereto, and wherein a state change of the ink is caused by the thermal energy to eject a droplet of ink from the ejection outlet.

13. An ink jet recording apparatus for recording an image on a recording material, comprising:

mounting means for mounting a recording head including an ejection outlet for ejecting ink, an energy generating element disposed proximate to the ejection outlet to generate energy for ejecting the ink, a temperature detecting element for detecting a temperature and information carrying means for carrying information relating to a characteristic curve providing a predetermined output for a predetermined temperature for said temperature detecting element;

correcting means for correcting an output of said temperature detecting means on the basis of information carried by said information carrying means and outputting a corrected signal; and outputting means for outputting a control signal for controlling the temperature of said recording head in accordance with the corrected signal, wherein said information carrying means includes a wiring pattern which is cut differently in accordance with the characteristic curve of said temperature detecting element.

14. An apparatus according to claim 13, wherein said energy generating element generates thermal energy in response to electric power supplied thereto, and wherein a state change of the ink is caused by the thermal energy to eject a droplet of ink from the ejection outlet.

15. A liquid jet recording apparatus for recording an image on a recording material, comprising a recording head having a temperature and having an ejection outlet for ejecting recording liquid, an energy generating element disposed corresponding to said ejection outlet to produce energy causing ejection of said recording liquid, and a temperature detecting element for detecting a temperature;

generating means for generating a correction value for a characteristic curve providing a predetermined output for a predetermined temperature for said temperature detecting element; and control means for outputting a control signal to be used for controlling the temperature of said recording head based on said correction value from said generating means and an output of said temperature detecting element.

16. A liquid jet recording apparatus according to claim 15, wherein said recording head is detachably mountable to said apparatus, further comprising mounting means for mounting said recording head to said apparatus, and wherein said generating means comprises an information carrying means included in said recording head for carrying information relating to the characteristic curve of said temperature detecting element, and generates said correction value based on said information carried on said information carrying means of said recording head mounted on said mounting means.

17. A liquid jet recording apparatus according to claim 16, wherein said information carrying means comprises a wiring pattern which is cut in a manner representing said output properties.

18. A liquid jet recording apparatus according to claim 16, wherein said recording head further comprises transmitting means for transmitting said information to said apparatus when said recording head is mounted to said apparatus.

19. A liquid jet recording apparatus according to claim 15, wherein said recording head is detachably mountable to said apparatus, wherein said generating means comprises a second temperature detecting element for detecting a second temperature which is adjacent to said recording head, said generating means generating said correction value based on said second temperature detected by said second temperature detecting element, and further comprising a display means for displaying a display relating to the correction operation of said control means.

20. A liquid jet recording apparatus according to claim 19, wherein said display means displays that said correction operation of said control means is proceeding.

21. A liquid jet recording apparatus according to claim 19, wherein said display means displays one of a success and a failure of said correcting operation.

22. A liquid jet recording apparatus according to claim 19, further comprising temperature control means for controlling the temperature adjacent to said recording head based on said control signal from said control means.

23. A liquid jet recording apparatus according to claim 19, wherein said second temperature detecting element has a temperature detecting accuracy which is higher than a temperature detecting accuracy of the first temperature detecting element.

24. A liquid jet recording apparatus according to claim 19, wherein said generating means generates said correction value based on an output of said second temperature detecting element, at a predetermined temperature.

25. A liquid jet recording apparatus according to claim 19, further comprising temperature control means for controlling a temperature based on said control signal from said control means so as to reach said predetermined temperature adjacent to said recording head prior to generation of said correction value.

26. A liquid jet recording apparatus according to claim 15, wherein said generating means comprises temperature detecting means for detecting an ambient temperature, wherein said generating means generates said correction value based on an output of said temperature detecting means and an output of said temperature detecting element.

27. A liquid jet recording apparatus according to claim 15 or 26, wherein said generating means generates said correction value when an unused recording head is mounted to said apparatus.

28. A liquid jet recording apparatus according to claim 27, wherein said recording head comprises information carrying means for carrying information which information indicates that said recording head is unused, and wherein said generating means generates said correction value in response to a one of a presence and an absence of said information.

29. A liquid jet recording apparatus according to claim 28, wherein said generating means destroys said information after generation of said correction value.

30. A liquid jet recording apparatus according to claim 15 or 26, wherein said generating means generates said correction value when the recording operation of said apparatus is interrupted for a predetermined period.

31. A liquid jet recording apparatus according to claim 15, 16, 19 or 24, wherein said energy generating element produces thermal energy in response to electric power supplied thereto.

* * * * *

UNITED STATES PATENT AND TRADEMARK OFFICE

CERTIFICATE OF CORRECTION

PATENT NO. : 5,485,182

DATED : January 16, 1996

INVENTOR(S) : YOSHIAKI TAKAYANAGI ET AL.

It is certified that error appears in the above-identified patent and that said Letters Patent is hereby corrected as shown below:

In the Drawings:

SHEET 14 OF 31

FIG. 19, "INSTRUSTIONS" should read --INSTRUCTIONS-- and "PREDTERMINED" should read --PREDETERMINED--.

COLUMN 3

Line 31, "FIG. 14A" should read --FIGS. 14A--.
Line 56, "FIGS. 22, 22A-22D" should read --FIGS. 22A-22D--.
Line 57, "thermis-tor." should read --thermistor.-.

COLUMN 4

Line 9, "FIGS. 30, 30A-30D" should read --FIGS. 30A-30D--.
Line 10, "thermis-tor" should read --thermistor--.
Line 36, "a" should read --an--.

UNITED STATES PATENT AND TRADEMARK OFFICE

CERTIFICATE OF CORRECTION

PATENT NO. : 5,485,182

DATED : January 16, 1996

INVENTOR(S) : YOSHIAKI TAKAYANAGI ET AL.

It is certified that error appears in the above-identified patent and that said Letters Patent is hereby corrected as shown below:

COLUMN 6

Line 17, "ROM" shuld read --a ROM--.
Line 20, "RAM" should read --a RAM--.
Line 24, "build" should read --built--.
Line 42, "off-set" should read --offset--.
Line 43, "FIG. 5, in" should read --FIG. 5. In--.

COLUMN 7

Line 42, "discriminated" should read --discriminated.--.
Line 43, "accordingly," should read --Accordingly,--.

COLUMN 9

Line 54, "numerals 51" should read --numeral 51--.
Line 60, "above mentioned" should read --above-mentioned--.

COLUMN 10

Line 3, "with" should read --width--.

UNITED STATES PATENT AND TRADEMARK OFFICE

CERTIFICATE OF CORRECTION

PATENT NO. : 5,485,182

DATED : January 16, 1996

INVENTOR(S) : YOSHIAKI TAKAYANAGI ET AL.

It is certified that error appears in the above-identified patent and that said Letters Patent is hereby corrected as shown below:

COLUMN 12

Line 30, "shows" should read --show--.
Line 31, "thermister 208." should read --thermistor 208.--.
Line 44, "FIG. 22B" should read --the FIG. 22B--.
Line 57, "carriage 206" should read --carriage 205--.

COLUMN 13

Line 50, "head 4" should read --head 204--.

COLUMN 14

Line 2, "is" should read --are--.

COLUMN 17

Line 40, "S135." should read --step S135.--.
Line 45, "S124." should read --step S124.--.
Line 50, "S124." should read --step S124.--.

COLUMN 18

Line 5, "step S25" should read --step S125--.
Line 8, "cooler 15" should read --cooler 215--.
Line 24, "heater 215" should read --cooler 215--.

UNITED STATES PATENT AND TRADEMARK OFFICE

CERTIFICATE OF CORRECTION

PATENT NO. : 5,485,182

DATED : January 16, 1996

INVENTOR(S) : YOSHIAKI TAKAYANAGI ET AL.

It is certified that error appears in the above-identified patent and that said Letters Patent is hereby corrected as shown below:

COLUMN 19

Line 23, "claim 5" should read --claim 5,--.

COLUMN 20

Line 1, "claim 8," should read --claim 9,--.

Signed and Sealed this

Twelfth Day of November, 1996

*Attest:*

Bruce Lehman

BRUCE LEHMAN

*Attesting Officer*

*Commissioner of Patents and Trademarks*